US007556338B2

(12) United States Patent
Iriguchi

(10) Patent No.: US 7,556,338 B2
(45) Date of Patent: Jul. 7, 2009

(54) JETTING TIMING DETERMINING METHOD AND LIQUID-DROPLET JETTING METHOD

(75) Inventor: Akira Iriguchi, Ichinomiya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 281 days.

(21) Appl. No.: 11/604,433

(22) Filed: Nov. 27, 2006

(65) Prior Publication Data

US 2007/0200889 A1 Aug. 30, 2007

(30) Foreign Application Priority Data

Nov. 28, 2005 (JP) ..... 2005-341344

(51) Int. Cl.
*B41J 29/393* (2006.01)
*B41J 29/38* (2006.01)

(52) U.S. Cl. ..... 347/19; 347/12; 347/14

(58) Field of Classification Search ..... 347/12, 347/14, 19

See application file for complete search history.

(56) References Cited

U.S. PATENT DOCUMENTS 4,730,197 A * 3/1988 Raman et al. ..... 347/40
5,160,938 A * 11/1992 Fargo et al. ..... 347/19
5,448,269 A * 9/1995 Beauchamp et al. ..... 347/19
2003/0071984 A1* 4/2003 Teramae et al. ..... 356/28
2003/0122886 A1* 7/2003 Adkins et al. ..... 347/19
2004/0212650 A1* 10/2004 King et al. ..... 347/19
2006/0139392 A1* 6/2006 Fernandez et al. ..... 347/19

FOREIGN PATENT DOCUMENTS

JP 2005271543 10/2005

* cited by examiner

*Primary Examiner*—Julian D Huffman
(74) *Attorney, Agent, or Firm*—Reed Smith LLP

(57) ABSTRACT

Combinations of delay times in jetting timings, for a predetermined number of nozzle groups selected from a plurality of nozzle groups, are set; and jetting speeds at each of the delay-time combinations are measured. Next, a variation in jetting speeds when the ink is jetted from the plurality of nozzle groups is estimated from the jetting speeds measured for each of the predetermined number of nozzle groups. Further, a combination of the delay times in the jetting timings is determined such that the estimated variation in the jetting speeds is smaller than a predetermined threshold value. Accordingly, it is possible to determine a combination of delay times in the jetting timings such that a variation in discharge characteristics when the ink is jetted concurrently from the plurality of nozzles is small, thereby improving the reproducibility of image.

21 Claims, 14 Drawing Sheets

JETTING TIMING DETERMINING METHOD AND LIQUID-DROPLET JETTING METHOD

CROSS-REFERENCE TO RELATED APPLICATION

The present application claims priority from Japanese Patent Application No. 2005-341344, filed on Nov. 28, 2005, the disclosure of which is incorporated herein by reference in its entirety.

BACKGROUND OF THE INVENTION

1. Field of the Invention

The present invention relates to a jetting timing determining method for determining a timing for jetting an ink from liquid-droplet jetting head such as an ink-jet head, and to a liquid-droplet jetting method.

2. Description of the Related Art

An ink-jet head described in Japanese Patent Application Laid-open Publication No. 2005-271543 is an example of an ink-jet head in which ink jetting characteristics of a nozzle which jets or discharges ink are improved.

SUMMERY OF THE INVENTION

When the ink is jetted or discharged from an ink-jet head as described in Japanese Patent Application Laid-open No. 2005-271543, a difference sometimes arises in jetting characteristics of the ink (ink-jetting characteristics) between a case in which the ink is jetted singly or independently from one nozzle (hereinafter referred to as "single jetting" or "independent jetting") within one printing cycle and a case in which the ink is jetted from a plurality of nozzles concurrently (hereinafter referred to as "concurrent jetting") within one printing cycle. For example, jetting velocity or speed at which the ink is jetted in the concurrent jetting is greatly smaller than that in the single jetting in some cases. This makes it the variation in the ink jetting speeds to be greater in the concurrent jetting than that in the single jetting.

As a cause to generate, more in the concurrent jetting than in the single jetting, such a variation in the jetting characteristics including the jetting speed, there is a phenomenon called "cross talk". The cross talk is a phenomenon in which the vibration or the like, generated in the ink-jet head when the ink is jetted from a certain nozzle, affects or influences the ink jetting from another nozzle different from the certain nozzle. When the ink jetting characteristics are varied or different among the nozzles upon the concurrent jetting due to the cross talk, there is a fear that an image, formed by the ink jetting, becomes non-uniform. Namely, the reproducibility of the printed image by the ink-jet head is lowered or deteriorated.

An object of the present invention is to provide a jetting timing determining method with which the variation in jetting speeds is small when the ink is jetted from a plurality of nozzles concurrently, thereby making the reproducibility of the printed image satisfactory, and to provide a method for jetting liquid droplets at jetting timings determined in such a manner.

The inventor of the present invention found out that when the ink is jetted from a plurality of nozzles, different jetting characteristics are obtained depending on a delay time (shift time) intervened in jetting timings for the nozzles.

According to a first aspect of the present invention, there is provided a jetting timing determining method for determining ink-jetting timings at which an ink is jetted from an ink-jet head having a plurality of nozzles including a first nozzle and a second nozzle which are to jet liquid droplets concurrently, the method including:

a jetting step for jetting a first liquid droplet from the first nozzle at a first timing and jetting a second liquid droplet from the second nozzle at a second timing which is delayed from the first timing by a predetermined period of time;

a measuring step for measuring a first jetting speed at which the first liquid droplet is jetted from the first nozzle and a second jetting speed at which the second liquid droplet is jetted from the second nozzle in the jetting step; and a first determining step for determining a delay time between the first timing and the second timing, based on the measured first and second jetting speeds.

According to the first aspect of the present invention, in the two nozzles which are to jet the liquid droplets concurrently, it is possible to determine an optimum delay time between the jetting timings at which the liquid droplets are jetted from the two nozzles respectively. For example, by determining the delay time between the jetting timings between the two nozzles such that the jetting speeds, at which the liquid droplets are jetted from the two nozzles respectively when the two nozzles jet the liquid droplet concurrently, becomes same as jetting speeds, at each of which the liquid droplet is jetted from one of the two nozzles when one of the two nozzles jets the liquid droplet independently from the other of the two nozzles, it is possible to suppress the cross talk which would otherwise occur when liquid droplets are jetted from these nozzles concurrently. The term "jetted concurrently" is not limited to a case in which the liquid droplets are jetted exactly concurrently, and it is allowable that the liquid droplets are jetted concurrently within a printing cycle, for example.

According to the jetting timing determining method of the present invention, the liquid droplets may be liquid droplets of an ink;

the liquid droplet head may be an ink-jet head;

the plurality of nozzles may form a plurality of nozzle groups;

the jetting step may include an ink-jetting step for performing jetting of the ink concurrently from nozzles, among the plurality of nozzles, which form selected nozzle groups among the nozzle groups, while changing among combinations of delay times by each of which a jetting timing at which the ink is jetted from one of the selected nozzle groups is delayed with respect to a predetermined timing;

in the measuring step, jetting speeds of the ink jetted from the selected nozzle groups, respectively, may be measured for each of the selected nozzle groups; and the first determining step may include:

a generating step for generating, from first delay-time combinations each of which is a combination of the delay times by each of which the jetting timing at which the ink is jetted from one of the selected nozzle groups is delayed with respect to the predetermined timing, second delay-time combinations each of which is a combination of delay times by each of which a jetting timing at which the ink is jetted from one of the nozzle groups is delayed with respect to the predetermined timing;

a first estimating step for estimating, with respect to each of the second delay-time combinations, a variation in jetting speeds at which the ink is concurrently jetted from nozzles included in each of the nozzle groups, with respect to a predetermined ink-jetting speed, from a variation in the jetting speeds measured for each of the selected nozzle groups in the measuring step; and a second determining step for determining a second delay-time combination, among the second delay-time combinations, in which the variation in the jetting speeds estimated in the first estimating step is smaller than a threshold value.

In this case, based on the jetting speeds estimated when the ink is jetted from the plurality of selected nozzle groups, respectively, with a delay time being intervened in the jettings from the selected nozzle groups, the variation in the jetting speeds when the ink is jetted from the plurality of nozzle groups is estimated. Further, when the ink is jetted from the plurality of nozzle groups, suitable jetting timings at which the variation in the jetting speeds becomes small are determined based on the estimated variation. Consequently, by adopting such jetting timings in the ink-jet head, an ink-jet head is realized in which the variation in the jetting speeds is small, and which is capable of forming a uniform image.

In the jetting timing determining method of the present invention, the ink-jetting step may be performed for a plurality of times by changing nozzle groups which belong to the selected nozzle groups, so that each of the plurality of nozzle groups belongs to the selected nozzle groups. In this case, when the jetting timings in all the nozzle groups are determined, the measurement result for the at least the ink-jetting performed one time is used for each of the nozzle groups. In other words, a sample for determining the appropriate jetting timings is secured assuredly.

In the jetting timing determining method of the present invention, the ink-jetting step may be performed for a plurality of times by changing nozzle groups which belong to the selected nozzle groups, so that the selected nozzle groups include all pairs of nozzle groups extracted from the plurality of nozzle groups. In this case, since the ink-jetting step is performed for all the pairs of the nozzle groups, it is possible to secure sufficient samples from which the combinations of all the nozzle groups can be formed.

In the jetting timing determining method of the present invention, the ink-jetting step may be performed by changing nozzle groups which belong to the selected nozzle groups while maintaining a number of the selected nozzle groups to be less than a number of all the nozzle groups. In this case, the combinations of the delay times in the plurality of nozzle groups are generated from the combinations of the delay times in the selected nozzle groups. Therefore, as compared to a case in which the ink jetting is performed for the combinations of all the delay times in the plurality of nozzle groups, the number of the times for jetting the ink is smaller.

In the jetting timing determining method according to the present invention, the ink-jetting step may be performed for a plurality of times by changing nozzle groups belonging to the selected nozzle groups, without changing a number of the nozzle groups included in the selected nozzle groups. In this case, since the number of the nozzle groups included in the selected nozzle groups is fixed, the combinations of the delay times are generated easily.

In the jetting timing determining method of the present invention, the ink-jetting step may include a concurrent-jetting step for jetting the ink concurrently from all the nozzles which belong to the selected nozzle groups;

the first estimating step may include a second estimating step for estimating, from the jetting speeds at which the ink is jetted in the concurrent-jetting step, a variation in the jetting speeds at which the ink is to be jetted concurrently from all the plurality of nozzles belonging to the nozzle groups; and in the second determining step, a second delay-time combination may be determined, from the second delay-time combinations, in which the variation in the ink jetting speeds estimated in the first estimating step is less than the variation in the ink jetting speeds estimated in the second determining step. In this case, jetting timings in which a variation in the jetting speeds is smaller than that in the concurrent jetting is determined assuredly.

In the jetting timing determining method of the present invention, the first estimating step may include:

a deriving step for deriving, for each of the nozzle groups, variations in the ink jetting speeds, measured in the measuring step, with respect to the predetermined ink-jetting speed;

an extracting step for extracting, from the variations in the ink jetting speeds derived in the deriving step, a combination of variations in the ink jetting speeds which corresponds to the second delay-time combination; and a step for estimating a variation in the ink jetting speeds at which the ink is to be jetted from the plurality of nozzle groups, based on the combination of the variations extracted in the extracting step. In this case, the variation in the ink jetting speeds in the plurality of nozzle groups is estimated by combining the variations derived from the measurement result for each of the nozzle groups. Accordingly, it is possible to easily estimate the variation in the jetting speeds, and to evaluate the variation objectively.

In the jetting timing determining method of the present invention, the ink-jet head may include a nozzle surface having a plurality of nozzle rows formed and aligned in parallel in the nozzle surface;

each of the nozzle rows may include nozzles among the plurality of nozzles; and the plurality of nozzle groups may be the plurality of nozzle rows. When a plurality of nozzle rows is formed, a variation in discharge characteristics due to the cross talk is easily occurred. Consequently, it is possible to prevent the variation in the discharge characteristics in such an ink-jet head.

In the jetting timing determining method of the present invention, the ink may include a plurality of color inks including a black ink; and in the ink-jetting step, nozzles which belong to a nozzle row, among the plurality of nozzle rows, may jet a color ink, among the color inks; and nozzles which belong to another nozzle rows different from the nozzle row may jet another color ink different from the color ink. In an ink-jet head which forms a color image, a difference in discharge characteristics easily affect or influence the quality of an image formed by the ink-jet head, Consequently, it is possible to prevent the variation in the discharge characteristics in such an ink-jet head.

In the jetting timing determining method of the present invention, the ink may include a plurality of color inks including a black ink;

the ink-jetting step may be performed such that a nozzle row, among the plurality of nozzle rows, which jets the black ink belongs to none of the selected nozzle groups; and the jetting timings at which the ink is jetted from the plurality of nozzles may be determined such that a jetting timing of a nozzle row, among the nozzle rows, which jets the black ink, is non-concurrent with a jetting timing of another nozzle row, among the nozzle rows, which jets a color ink other than the black ink. In this case, with respect to the nozzle rows including the nozzle row which jets the black ink, the jetting timings are determined for the plurality of nozzle rows without jetting the black ink from the nozzle row for the black ink. Accordingly, it is possible to determine the jetting timings in a smaller number of steps. Consequently, the ink jetting from a nozzle group (nozzle row) which jets the color ink other than the black ink is hardly affected by the ink jetting from the nozzle group (nozzle row) which jets the black ink.

In the jetting timing determining method of the present invention, each of the nozzles may belong to one of the plurality of nozzle groups. In this case, the jetting timings are determined such that the variation in the jetting speeds is small for all the nozzles formed in the ink-jet head.

In the jetting timing determining method of the present invention, an ink-jetting performed by the ink-jet head may include a plurality of modes which are mutually different in an amount of the ink jetted from the nozzles; and in the ink-jetting step, the ink may be jetted from the nozzles in a mode in which the ink is jetted in a least amount among the modes. In this case, even for an ink-jet head which is driven in a plurality of jetting modes different in an amount of jetted ink, the timings of ink jetting are determined upon considering a jetting mode in which the variation in the jetting speeds is most easily occur. Therefore, even more appropriate timing may be determined.

In the jetting timing determining method of the present invention, an ink-jetting performed by the ink-jet head may include a plurality of modes which are mutually different in an amount of the ink jetted from the nozzles;

the ink maybe jetted from the nozzles in each of the modes; and in the second determining step, the second delay-time combination may be determined in each of the modes. In this case, appropriate timings to jet the ink may be determined in accordance with the amount of the ink to be jetted.

In the jetting timing determining method of the present invention, the nozzle rows may be formed as four nozzle rows in the ink-jet head. In this case, appropriate timings may be determined even when there are not less than four nozzle rows.

According to a second aspect of the present invention, there is provided a liquid-droplet jetting method for jetting liquid droplets from a liquid-droplet jetting head having a plurality of nozzles including a first nozzle and a second nozzle which are to jet the liquid droplets concurrently, the method including:

a jetting step for jetting a first liquid droplet from the first nozzle at a first timing and for jetting a second liquid droplet from the second nozzle at a second timing which is delayed from the first timing by a predetermined period of time;

a measuring step for measuring a first jetting speed at which the first liquid droplet is jetted from the first nozzle and a second jetting speed at which the second liquid droplet is jetted from the second nozzle in the jetting step;

a first determining step for determining a delay time between the first timing and the second timing, based on the measured first and second jetting speeds; and a step for jetting the first liquid droplet from the first nozzle and the second liquid droplet from the second nozzle, by the delay time determined in the first determining step.

According to the second aspect of the present invention, in two nozzles which are to jet liquid droplets concurrently, it is possible to determine a delay time between the jetting timings for the two nozzles respectively based on the jetting speeds at which the liquid droplets are jetted from the two nozzles respectively, and the liquid droplets can be jetted from the two nozzles by the delay time determined in such a manner. For example, by determining the delay time between the jetting timings at which the liquid droplets are jetted from the two nozzles respectively, such that the jetting speed, at which the liquid droplets are jetted from the two nozzles respectively when the two nozzles jet the liquid droplet concurrently, become same as jetting speeds, at each of which the liquid droplet is jetted from one of the two nozzles when one of the two nozzles jets the liquid droplet independently from the other of the two nozzles, it is possible to suppress the cross talk which would otherwise occur when liquid droplets are jetted from these nozzles concurrently. This in turn makes it possible to jet the liquid droplets concurrently from the two nozzles in a state that such cross talk is suppressed In the liquid-droplet jetting method, the liquid droplets may be liquid droplets of an ink;

the plurality of nozzles may form a plurality of nozzle groups;

the jetting step may include an ink-jetting step for performing jetting of the ink concurrently from nozzles, among the plurality of nozzles, which form selected nozzle groups among the nozzle groups, while changing among combinations of delay times by each of which a jetting timing at which the ink is jetted from one of the selected nozzle groups is delayed with respect to a predetermined timing;

in the measuring step, jetting speeds of the ink jetted from the selected nozzle groups, respectively in the ink-jetting step, may be measured for each of the selected nozzle groups; and the first determining step may include:

a generating step for generating, from first delay-time combinations each of which is a combination of the delay times by each of which the jetting timing at which the ink is jetted from one of the selected nozzle groups is delayed with respect to the predetermined timing, second delay-time combinations each of which is a combination of delay times by each of which a jetting timing at which the ink is jetted from one of the nozzle groups is delayed with respect to the predetermined timing;

a first estimating step for estimating, with respect to each of the second delay-time combinations, a variation in jetting speeds at which the ink is concurrently jetted from the nozzles included in each of the nozzle groups, from a variation in the jetting speeds measured for each of the selected nozzle groups in the measuring step; and a second determining step for determining a second delay-time combination, among the second delay-time combinations, in which the variation in the jetting speeds estimated in the first estimating step is smaller than a threshold value.

In this case, a variation in the jetting speeds at which the ink is jetted from a plurality of nozzle groups, is estimated; and appropriate jetting timings are determined such that the variation becomes small, based on the estimated variation. Accordingly, it is possible to jet the liquid droplets at the jetting timings by which the variation in jetting speeds of the liquid droplets is small, thereby suppressing the cross talk.

In the liquid-droplet jetting method of the present invention, the ink-jetting step may include a concurrent-jetting step for jetting the ink concurrently from all the nozzles which belong to the selected nozzle groups;

the first estimating step may include a second estimating step for estimating, from the jetting speeds at which the ink is jetted in the concurrent-jetting step, a variation in the jetting speeds at which the ink is to be jetted concurrently from all the plurality of nozzles belonging to the nozzle groups; and in the second determining step, a second delay-time combination may be determined, from the second delay-time combinations, in which the variation in the ink jetting speeds estimated in the first estimating step is less than the variation in the ink jetting speeds estimated in the second determining step. In this case, jetting timings in which a variation in the jetting speeds is smaller than that in the concurrent jetting is determined assuredly. Accordingly, it is possible to jet a liquid such as an ink in a state that the cross talk is suppressed.

In the liquid-droplet jetting method of the present invention, the first estimating step may include:

a deriving step for deriving, for each of the nozzle groups, variations in the ink jetting speeds, measured in the measuring step, with respect to the predetermined ink-jetting speed;

an extracting step for extracting, from the variations in the ink jetting speeds derived in the deriving step, a combination of variations in the ink jetting speeds which corresponds to the second delay-time combination; and a step for estimating a variation in the ink jetting speeds at which the ink is to be jetted from the plurality of nozzle groups, based on the combination of the variations extracted in the extracting step. In this case, it is possible to jet a liquid such as an ink in a state that the cross talk is suppressed.

In the liquid-droplet jetting method of the present invention, the liquid-droplet jetting apparatus may be an ink-jet head including a nozzle surface which has nozzle rows formed and aligned in parallel in the nozzle surface;

each of the nozzle rows may include nozzles among the plurality of nozzles; and the plurality of nozzle groups may be the plurality of nozzle rows. In this case, even for a liquid-droplet jetting head such as an ink-jet head having a plurality of nozzle rows formed therein, it is possible to jet a liquid such as an ink while suppressing the cross talk to prevent the variation in discharge characteristics.

In the liquid-droplet jetting method of the present invention, the ink may include a plurality of color inks including a black ink; and in the ink-jetting step, nozzles, among the plurality of nozzles, which belong to a nozzle row, among the nozzle rows, may jet a color ink, among the color inks; and nozzles which belong to another nozzle rows different from the nozzle row may jet another color ink different from the color ink. In this case, also in an ink-jet head which forms a color image, the inks can be jetted while suppressing the variation in the jetting characteristics.

DETAILED DESCRIPTION OF THE PREFERRED EMBODIMENTS

In the following, a preferred embodiment of the present invention will be explained. First, an explanation will be given about an ink-jet head which is an object of the jetting-timing determining method of the present invention. Then, a printer provided with the ink-jet head will be explained. Next, a preferred embodiment according to the jetting-timing determining method will be explained.

Figure 1:
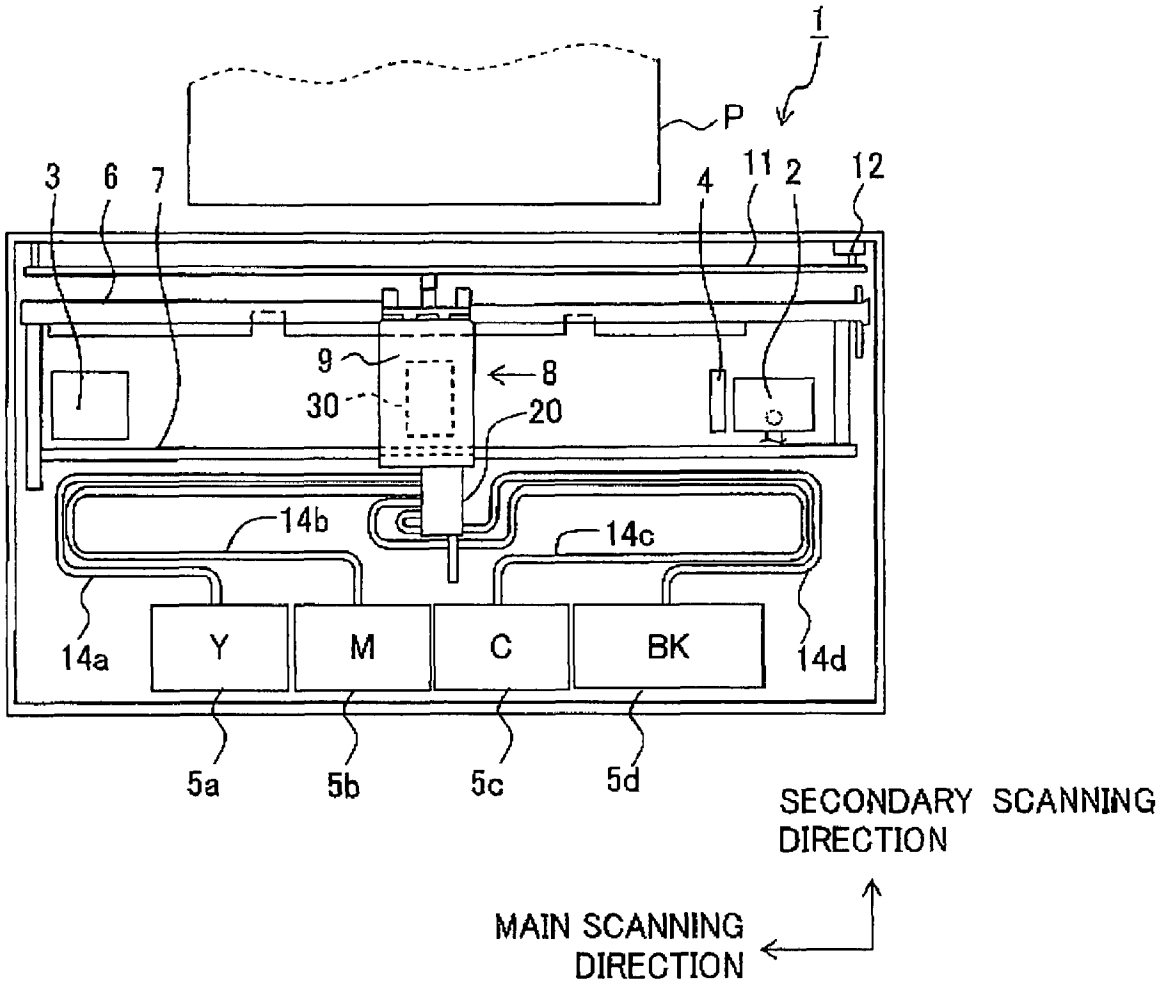
FIG. 1 is a schematic top view showing an example of an ink-jet printer to which the jetting-timing determining method of the present invention is applied.

FIG. 1 shows an example of the ink-jet printer 1 (hereinafter referred to as "printer 1") as an object of the jetting-timing determining method of the present invention. FIG. 1 shows the inside of the printer 1 as viewed from above.

In the inside of the printer 1, two guide shafts 6 and 7 are provided. A head unit a, which functions as a carriage, is arranged in the guide shafts 6 and 7 to be reciprocapable along a main scanning direction (left and right direction in FIG. 1). The head unit 8 has a head holder 9 which is formed of a synthetic resin material. The head holder 9 holds an ink-jet head 30 which performs printing by discharging an ink onto a recording paper P fed or transported at a position below the head unit 8.

A carriage motor 12 is arranged in the printer 1. An endless belt 11, which is rotated by being driven by the carriage motor 12, is attached to a driving shaft of the carriage motor 12. The head holder 9 is attached to the endless belt 11, and the head holder 9 reciprocates along the main scanning direction when the endless belt is rotated.

The printer 1 has ink cartridges 5*a*, 5*b*, 5*c* and 5*d*. These ink cartridges 5*a* to 5*d* accommodate a yellow ink, a magenta ink, a cyan ink and a black ink, respectively. Each of the cartridges 5*a* to 5*d* are connected to a tube joint 20 arranged in the head unit 8, via flexible tubes 14*a*, 14*b*, 14*c* and 14*d*, respectively. The inks in the ink cartridges 5*a* to 5*d* are supplied to the head unit 8 via the tube joint 20.

The printer 1 has an ink-absorbing member 3 arranged at a position, in the printer 1, at one end in the main scanning direction defined by the guide shafts 6 and 7. The ink-absorbing member 3 is positioned just below the head unit 8 when the head unit 8 is moved, on the guide shafts 6 and 7, to the one end in the main scanning direction. The ink-absorbing member 3 absorbs the ink jetted, during a flushing operation, from nozzles formed in the head unit 8 on a nozzle surface thereof. The printer 1 has a purge unit 2 arranged between the guide shafts 6 and 7 at a position opposite, in the main scanning direction, to the ink-absorbing member 3. The purge unit 2 sucks the ink from the nozzles during the purge operation.

A wiper 4 is provided on the printer 1 between the guide shafts 6 and 7 at a position adjacent, in the main scanning direction, to the purge unit 2. The wiper 4 wipes the ink, adhered to the nozzle surface, from the nozzle surface.

Figure 2:
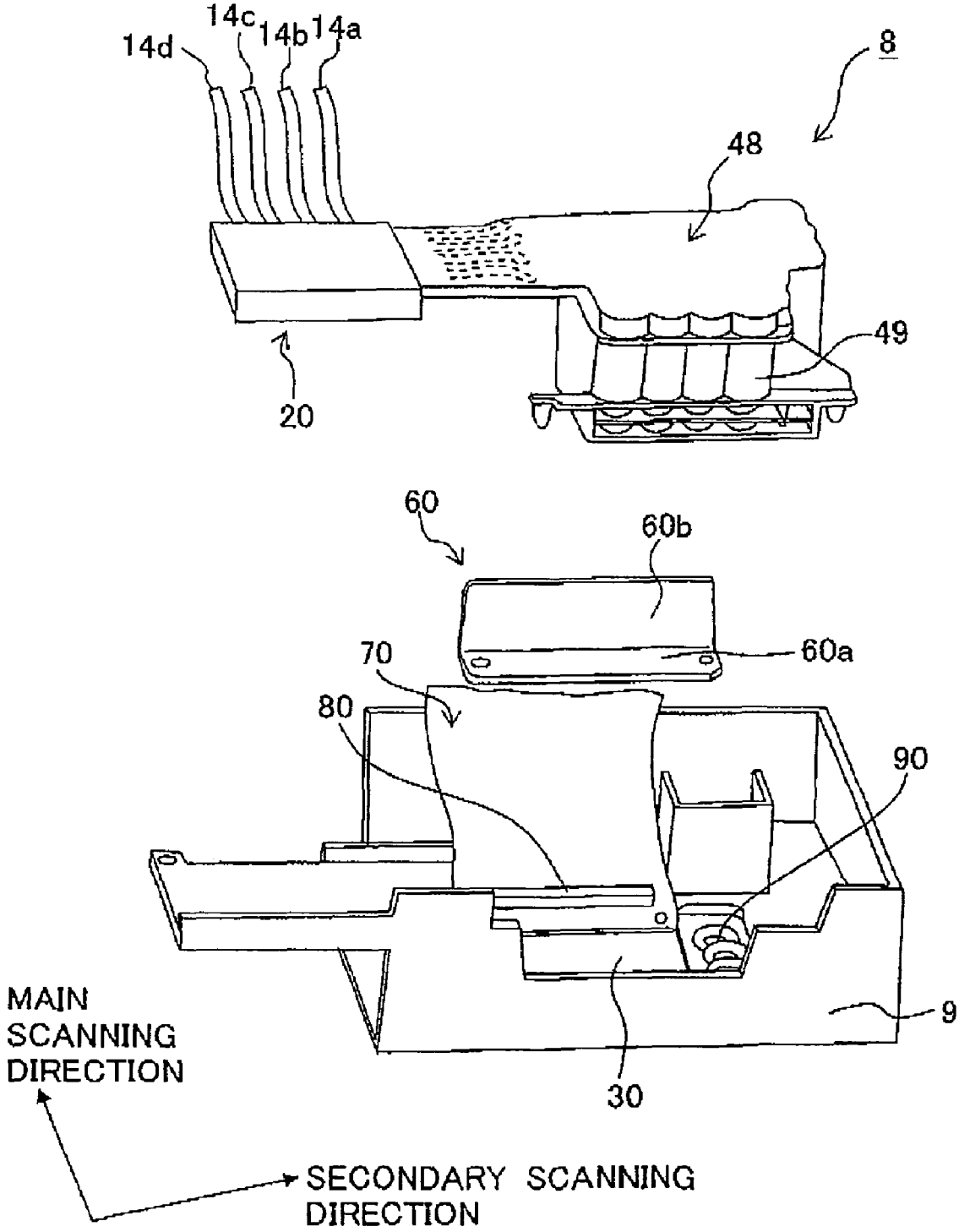
FIG. 2 is an exploded perspective view of a head unit shown in FIG. 1.

Next, the head unit 8 will be explained. FIG. 2 shows the head unit 8 in a state that a buffer tank 48 and a heat sink 60 are detached or removed from the head holder 9.

The head holder 9 is formed in a substantially box shape which is open toward a side (upper side in FIG. 2) in which the head holder 9 accommodates or receives the buffer tank 48 (ink channel unit) therein. The ink-jet head 30 is arranged in the bottom portion of the head holder 9. The buffer tank 48 is accommodated in the head holder 9 to be positioned above the ink-jet head 30.

The tube joint 20 is connected to a portion, on the upper surface of the buffer tank 48, in the vicinity of one end thereof. As described above, the tube joining 20 is connected to the ink cartridges 5*a* to 5*d* via the tubes 14*a*, 14*b*, 14*c* and 14*d*, respectively. The inks are supplied to the buffer tank 48 from the ink cartridges 5*a* to 5*d* via the tubes 14*a* to 14*d*, respectively. Although not shown in the drawing, four ink outlet ports are provided in the lower surface of the buffer tank 48. These ink outlet ports are connected to four ink supply ports 91*a*, 91*d*, 91*c* and 91*d*, respectively, arranged in the ink-jet head 30 via a seal member 90, as will be described later on.

The head holder 9 has the heat sink 60. The heat sink 60 has a horizontal portion 60*a* extending in a sub scanning direction (up and down direction in FIG. 1; left and right direction in FIG. 2), and a vertical portion 60*b* rising upward from one end of the horizontal portion 60*a*. As shown in FIG. 2, each of the horizontal portion 60*a* and the vertical portion 60*b* is formed to have a plate shape which is long in the sub scanning direction.

From the head holder 9, a Flexible Printed Circuit (FPC) 70 (to be described later) is drawn upward to pass through a gap defined in the bottom portion of the head holder 9. One end of the FPC 70 is connected to a head body 25 of the ink-jet head 30, and the other end of the FPC 70 is electrically connected to a control unit (not shown in the drawing) of the printer 1. The control unit of the printer 1 controls, via the FPC 70, the ink jetting (ink discharge) from the head body 25, based on an image data. A driver IC 80 is arranged in the FPC 70, at an intermediate portion between the one end of the FPC 70 connected to the head body 25 and the other end connected to the control unit.

Figure 3:
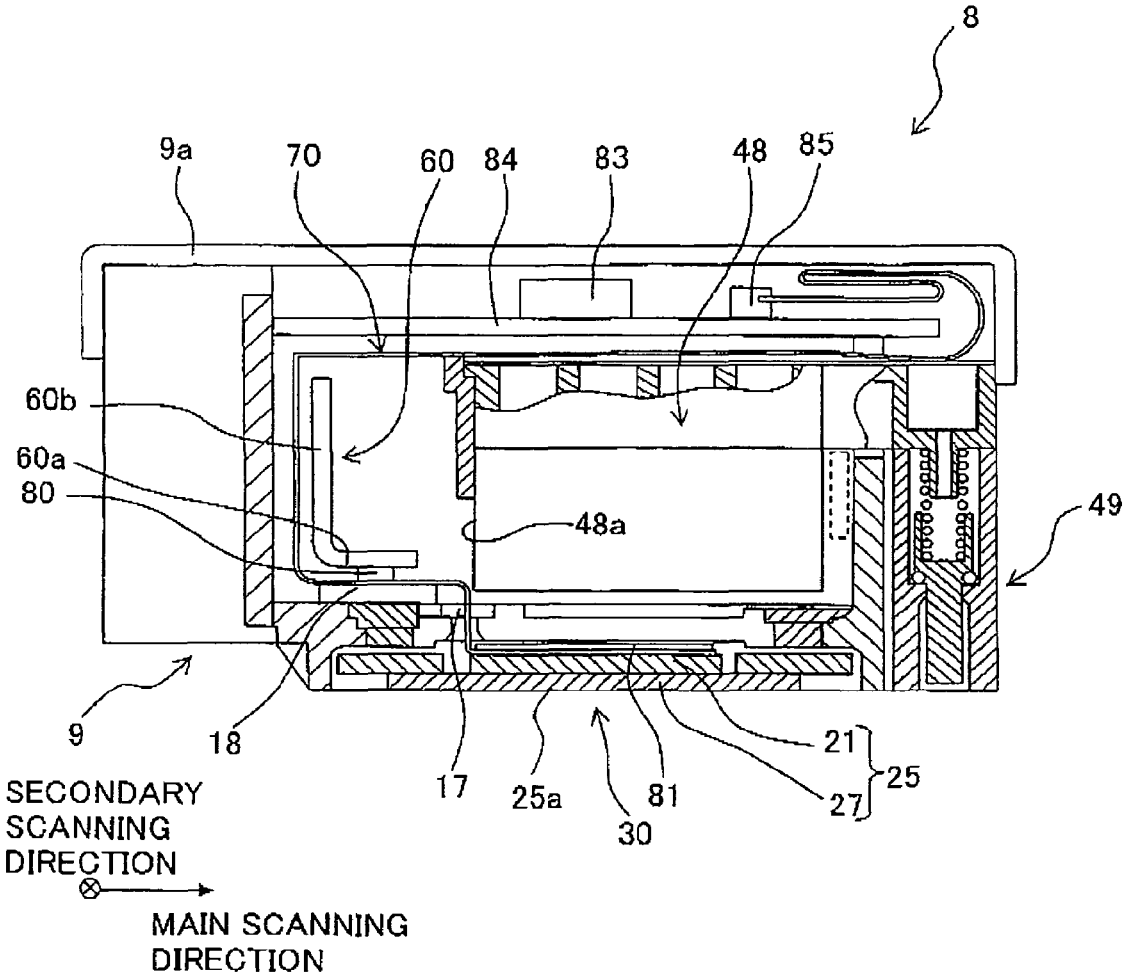
FIG. 3 is a vertical cross-sectional view of the head unit shown in FIG. 1.

FIG. 3 is a vertical sectional view of the head unit 8 taken along the main scanning direction. FIG. 3 shows the head unit 8 in a state that the buffer tank 48 and the heat sink 60 are accommodated in the head unit 8.

The heat sink 60 is fixed to a position (the left side in FIG. 3) which is opposite to the buffer tank 48 in the main scanning direction, and which is adjacent to a side wall 48*a* of the buffer tank 48. A surface of the vertical portion 60*b* in the heat sink 60 faces the side wall 48*a*. The horizontal portion 60*a* of the heat sink 60 is arranged in the head holder 9 on the bottom portion thereof, so that short side of the horizontal portion 60*a* extends in the main scanning direction.

A control board 84, on which a connector 85 and electrical parts such as a capacitor 83 are mounted, is arranged at a position above the buffer tank 48. The upper side of the control board 84 is covered by a cover 9*a* which is to be the upper cover of the head holder 9.

An exhaust unit (air discharge unit) 49 is arranged in the buffer tank 48 at a side surface thereof at one side in the main scanning direction (right side in FIG. 3). The exhaust unit 49 discharges the air accumulated in the buffer tank 48 to the outside.

The ink-jet head 30, arranged on the bottom portion of the head holder 9, has the head body 25. The head body 25 is firmly fixed to the bottom portion of the head holder 9, as will be described later, and has a nozzle surface (lower surface, bottom surface) 25*a*. The nozzle surface 25*a*, in which a plurality of nozzles is formed, is arranged to the head body 25 such that the nozzle surface 25*a* is exposed downward to the outside of the head holder 9. The head body 25 has a piezoelectric actuator 21 and a channel unit 27 which will be described later on.

The FPC 70 is electrically connected to the piezoelectric actuator 21 at a portion of the FPC in the vicinity of one end thereof. The other end of the FPC 70 is electrically connected to the connector 85, which is provided above the buffer tank 48, via the following route. First, the other end of the FPC 70 is drawn upward passing through a hole 17 formed in the bottom portion of the head holder 9. Then, the drawn FPC 70 advances upward passing through a gap defined between the heat sink 60 and an inner surface of the head holder 9. Afterwards, the FPC 70 extends upward along an inner surface on one side in the head holder 9, is bent at a portion in the vicinity of the control board 84, further to extend in the main scanning direction along the lower surface of the control board 84. Further, the FPC 70 is bent upward at a portion in the vicinity of an inner surface on the other side in the head holder 9, passes through a gap defined between an end portion of the control board 84 and the other inner surface of the head holder 9 to be drawn on the upper surface, of the control board 84, to the side in which the connecter 85 is formed. The connector 85 is electrically connected to the control unit of the printer 1 in an unillustrated route.

The driver IC 80 is arranged in the FPC 70 as described above. The driver IC 80 is arranged in the FPC 70 on the surface thereof facing the horizontal portion 60*a* of the heat sink 60, to be located at a position below the heat sink 60. Further, an elastic member 18 is arranged at a position below the driver IC. The FPC 70 is pressed by the elastic member 18 so that upper surface of the driver IC 80 makes contact with the horizontal portion 60*a* of the heat sink 60. The driver IC 80, when excessively heated, releases heat via the heat sink 60.

A heat-conducting body 81 is arranged in the FPC 70 at an area thereof facing the piezoelectric actuator 21. The heat-conducting body 81 is an aluminum plate with a uniform thickness and has a shape in a plan view which is substantially same as that of the upper surface of the piezoelectric actuator 21. The heat-conducting body 81 releases the heat, generated from the piezoelectric actuator 21 and from the FPC 70 in the portion facing the piezoelectric actuator 21.

Figure 4:
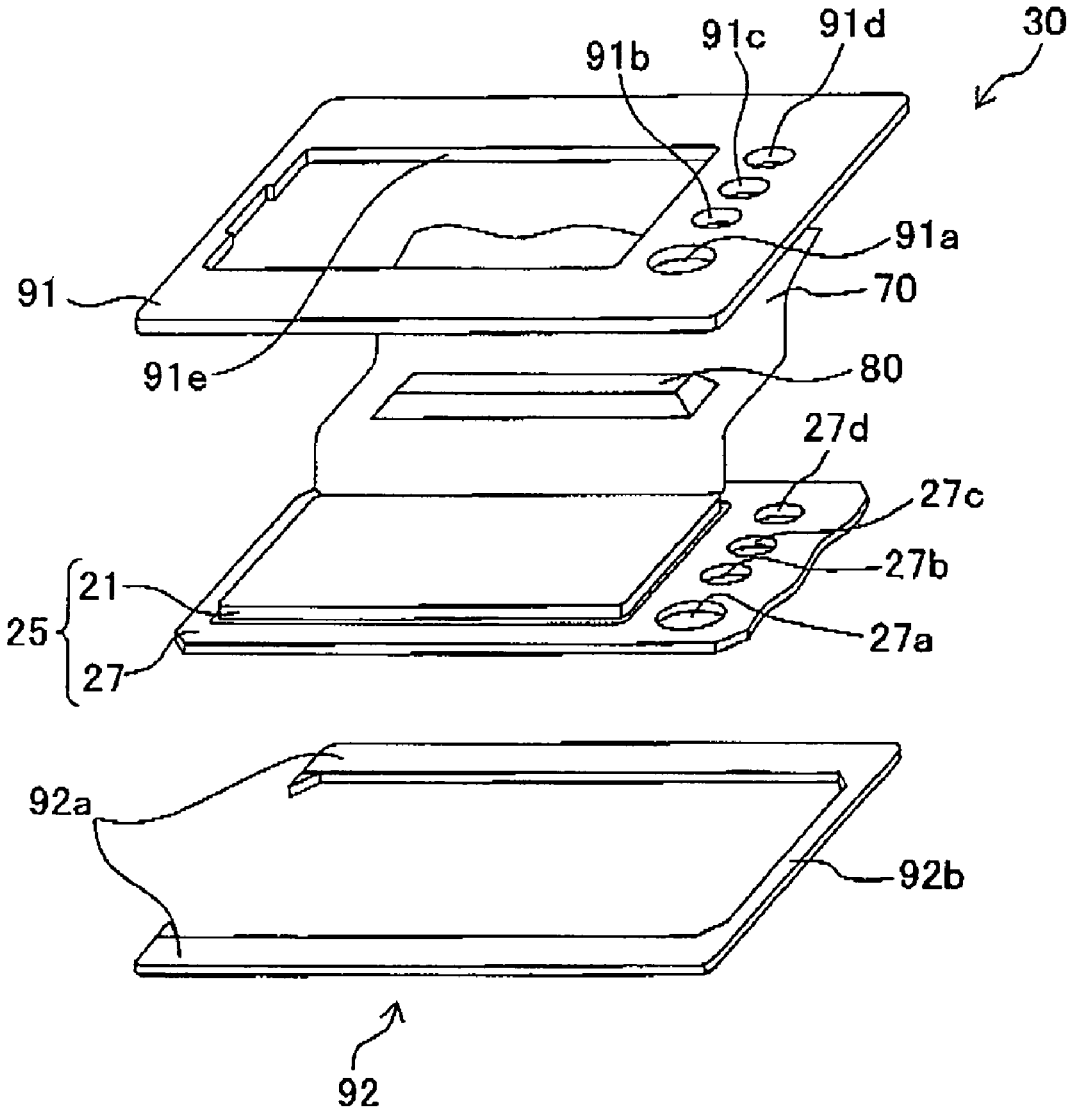
FIG. 4 is an exploded perspective view of the ink-jet head shown in FIG. 2.

Next, the ink-jet head 30 will be explained. FIG. 4 is an exploded perspective view of the ink-jet head 30. The ink-jet head 30 has the head body 25, a reinforcing frame 91 and a protective frame 92. FIG. 4 shows the head body 25, the reinforcing frame 91 and the protective frame 92.

The head body 25 has the piezoelectric actuator 21 and the channel unit 27. As will be described later, the channel unit 27 has a stack formed by stacking a plurality of sheet members which have a same rectangular planar shape (see FIG. 5). Ink supply ports 27*a*, 27*b*, 27*c* and 27*d* are formed in the channel unit 27 at one end in the longitudinal direction thereof. The ink supply ports 27*a* to 27*d* are arranged along a short direction of the head body 25 such that the ink supply ports are isolated and away from one another. The inks are supplied from the buffer tank 48 to the channel unit 27 via the ink supply ports 27*a* to 27*d*. A plurality of nozzles, which jet (discharge) the ink, is formed in the channel unit 27 on the lower surface thereof. Accordingly, the lower surface of the channel unit 27 corresponds to the nozzle surface 25*a*. The ink channel, from the ink supply ports 27*a* to 27*d* and communicating with the nozzles, is formed in the inside of the channel unit 27.

Further, the piezoelectric actuator 21 (to be described later) is arranged on the upper surface of the channel unit 27, at a position where the piezoelectric actuator 21 avoids (does not interfere or overlap with) the ink supply ports 27*a* to 27*d*. The piezoelectric actuator 21 forms a part of inner wall (pressure chambers, to be explained later) of the ink channel formed in the channel unit 27, and applies a pressure to the ink in the ink channel, thereby jetting the ink from the nozzles. The FPC 70 is electrically connected to the piezoelectric actuator 21, as described above.

The reinforcing frame 91 is a metal member having a rectangular shape in a plan view. An opening 91*e* is formed in the reinforcing frame 91 to correspond to the piezoelectric actuator 21 in the head body 25. The opening 91*e* has a shape substantially same as that of the piezoelectric actuator 21, and has a size greater to some extent than that of the piezoelectric actuator 21, as a whole. In addition, the opening 91*e* has the size smaller to some extent than that of the channel unit 27, as a whole. Namely, the opening 91*e* has an opening area greater to some extent than the contour of the piezoelectric actuator 21 and is smaller to some extent than the contour of the channel unit 27. Further, the opening 91*e* is formed in the reinforcing frame 91 to be offset in the longitudinal direction of the reinforcing frame 91, and at a position near to the center, in the short direction, of the reinforcing frame 91.

Ink supply ports 91*a*, 91*b*, 91*c* and 91*d* are formed to penetrate through the reinforcing frame 91 in the thickness direction, at a portion of the reinforcing frame 91 on a side of one end in the longitudinal direction. The ink supply ports 91*a* to 91*d* are formed to correspond to the ink supply ports 27*a* to 27*d*, respectively, in the channel unit 27. Further, the ink supply ports 91*a* to 91*d* are formed along the short direction of the reinforcing frame 91 so as to be isolated and away from one another. The ink supply ports 91*a* to 91*d* have shapes which are same as those of the ink supply ports 27*a* to 27*d*, respectively, formed in the head body 25.

The protective frame 92 is a metal plate member formed to have a "U"-shape in a plan view. The protective frame 92 has two arm portions 92*a*, in the U-shaped form thereof, which are parallel to each other and have a length substantially same as that in a length in the longitudinal direction of the reinforcing frame 91. The reinforcing frame 92 further has a support portion 92*b* which supports the two arm portions 92*a*. The support portion 92*b*, which is orthogonal to the arm portions 92*a*, has a length substantially same as the length in the short direction of the reinforcing frame 91. In a plane including the cross section of the protective frame 92, an area, surrounded by the horizontal U-shaped protective frame 92, has a shape substantially same as that of the main body 25 and is greater in size to some extent than that of the head body 25.

The ink-jet head 30 is formed by joining or adhering the head body 25, the reinforcing frame 91 and the protective frame 92 together. The head body 25 and the reinforcing frame 91 are adhered so that the piezoelectric actuator 21 is accommodated inside the through hole (opening 91*e*) formed in the reinforcing frame 91, and that the lower surface of the reinforcing frame 91 and the periphery portion of the piezoelectric actuator 21 arranged on the upper surface of the channel unit 27 are in contact with each other, thereby exposing the upper surface of the piezoelectric actuator 21 upwardly in the opening 91*e* in the reinforcing frame 91. Further, the protective frame 92 is adhered to the lower surface of the reinforcing frame 91 so that the channel unit 27 is surrounded by the protective frame 92. In other words, the nozzle surface 25*a* of the channel unit 27 is exposed downwardly in an area inside the U-shaped protective frame 92.

When the reinforcing frame 91 and the head body 25 are adhered together, the ink supply ports 27*a* to 27*d* are positioned such that the ink supply ports 27*a* to 27*d* are communicated with the ink supply ports 91*a* to 91*d*, respectively.

Figure 5A:
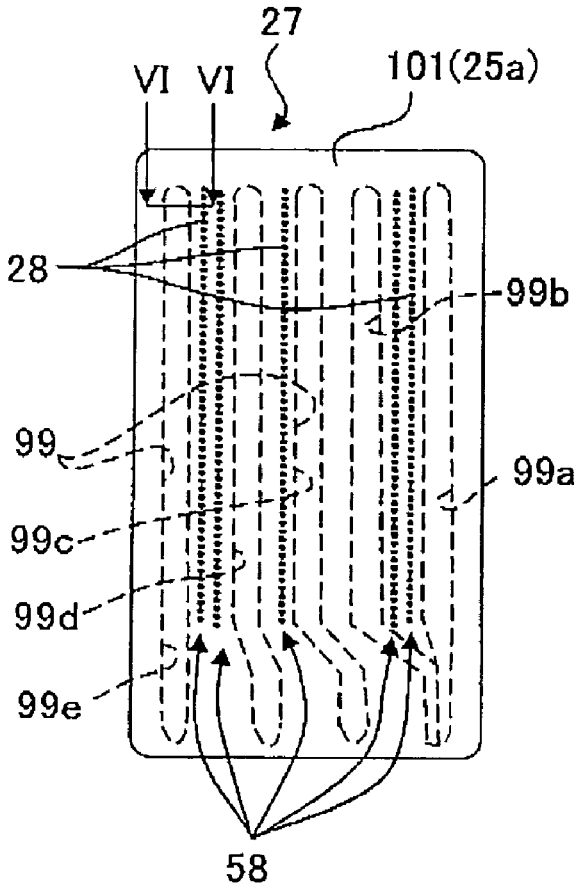
FIGS. 5A and 5B are bottom and top views, respectively, of a channel unit shown in FIG. 2.
Figure 5B:
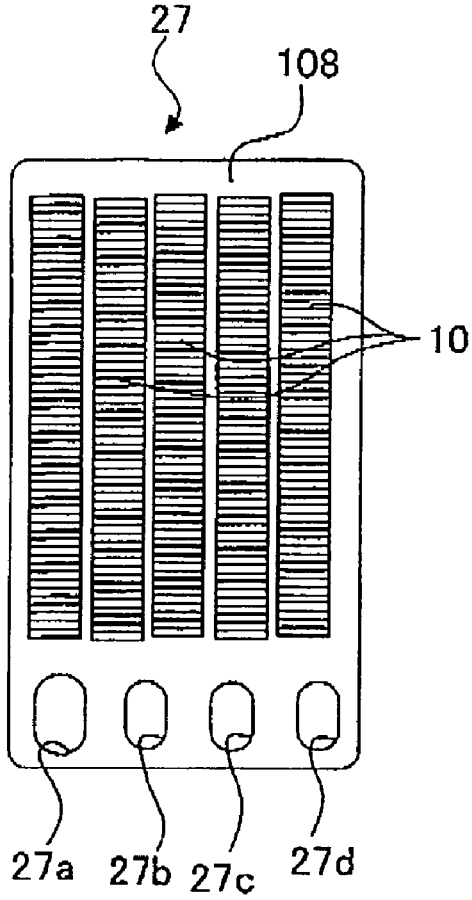

FIGS. 5A and 5B are bottom and top views, respectively, of the channel unit 27. As described above, the lower surface of the channel unit 27 is the nozzle surface 25*a* in which a plurality of nozzles 28 are formed. As shown in FIG. 5A, the nozzles 28 are arranged in a staggered manner along the longitudinal direction of the channel unit 27, thereby forming five nozzle rows 58. In the channel unit 27, five common ink chambers 99*a*, 99*b*, 99*c*, 99*d* and 99*e* are formed to extend along the nozzle rows 58, respectively. Each of the common ink chambers 99*a* to 99*e* is formed in the channel unit 27 in an area not overlapping, in the thickness direction of the channel unit 27, with any one of the nozzles 28, such that the common ink chambers 99*a* to 99*e* avoid the nozzle rows 58, respectively. In the channel unit 27, individual ink channels are further formed. Each of the individual ink channels communicates with one of the nozzles 28 via one of the common ink chambers 99*a* to 99*d*. The ink, filled in each of the common ink chambers 99*a* to 99*d*, is supplied to the nozzles 28 via the individual ink channels, respectively.

As shown in FIG. 5B, pressure chambers 10 are formed in the upper surface of the channel unit 27. Each of the pressure chambers 10 is a cavity which is open, in the upper surface of the channel unit 27, to the outside of the channel unit 27. These pressure chambers 10 are arranged in five rows in a staggered manner, and correspond to the nozzles 28, respectively. Each of the pressure chambers 10 constructs a part of one of the individual ink channels communicating from one of the common ink chambers 99*a* to 99*d* to the nozzles 28, respectively. As will be described later, by adhering the piezoelectric actuator 21 to the upper surface of the channel unit 27, the openings of the pressure chambers 10 are covered by the piezoelectric actuator 21. In other words, the surface, of the piezoelectric actuator adhered to the channel unit 27, forms one of inner surfaces of each of the pressure chambers 10.

The ink supply ports 27*a* to 27*d* are formed in the upper surface of the channel unit 27. Further, ink channels (now shown), communicating with the common ink chambers 99*a* to 99*e* respectively, are formed in the channel unit 27. Via such ink channels, the ink supply port 27*a* communicates with the common ink chambers 99*a* and 99*b*; and the ink supply ports 27*b* to 27*d* communicate with the common ink chambers 99*c* to 99*e*, respectively. The ink, supplied to the ink supply port 27*a* is filled in the common ink chambers 99*a* and 99*b*; and the inks supplied to the ink supply ports 27*b* to 27*d* are filled in the common ink chambers 99*c* to 99*e*, respectively.

Figure 6:
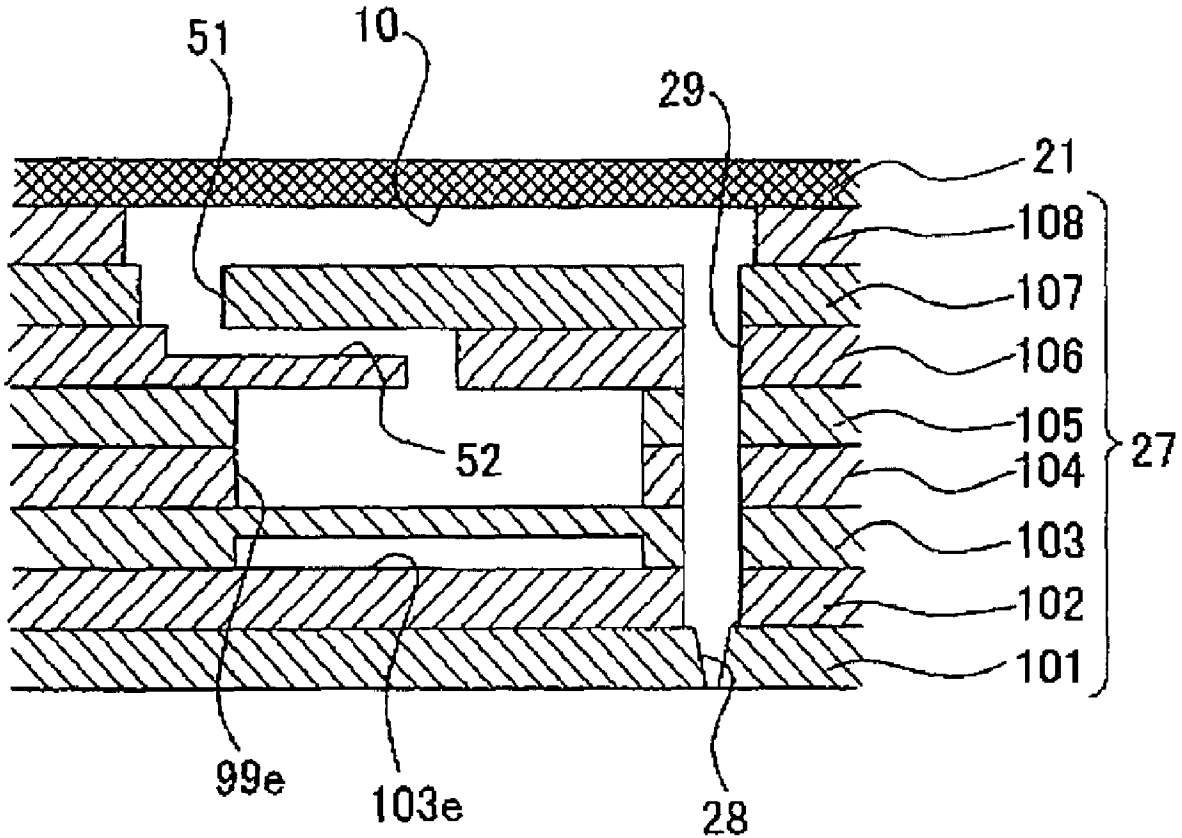
FIG. 6 is an enlarged view of a cross section of the channel unit shown in FIG. 2.

FIG. 6 is a vertical cross-sectional view along VI-VI line in FIG. 5A. FIG. 6 shows a state in which the piezoelectric actuator 21 is adhered to the channel unit 27. Although FIG. 6 shows a vertical section of a portion in the vicinity of the common ink chamber 99*e*, portions in the vicinity of the common ink chambers 99*a* to 99*d*, respectively, are constructed in a same manner. In the following, a channel unit communicating with the common ink chamber 99*e* is explained as an example, channel units communicating with the common ink chambers 99*a* to 99*d*, respectively, are constructed in a similar manner.

As shown in FIG. 6, the channel unit 27 is a stack in which a plurality of plates are stacked or laminated in layers. A plurality of channel holes constructing the common ink chamber 99*e*, the nozzles 28, and the ink channels are formed in each of the plates. The channel unit 27 is formed by stacking the plates such that these channel holes are mutually communicated to form the common ink chamber 99*e*, the ink channels, and the like. These plates are formed of a metallic material, a polyimide resin material, or the like.

The plates constructing the channel unit 27 includes the nozzle plate 101, a cover plate 102, a damper plate 103, two manifold plates 103 and 104, an aperture plate 106, a supply plate 107 and a cavity plate 108, and these plate are stacked in an order in the channel unit 27. The nozzles 28 are formed in the nozzle plate 101, and the pressure chambers 10 are formed in the cavity plate 108. Each of the remaining plates, sandwiched between the plates 101 and 108, has channel holes constructing the individual ink channels formed therein. Each of the individual ink channels starts from the common ink chamber 99*e* and reaches one of the nozzles 28 via one of the pressure chambers 10.

Channel holes constructing the common ink chamber 99*e* are formed in the manifold plates 104 and 105. Apertures 52 (throttled portions) are formed in the aperture plate 106. Each of the apertures 52 is communicated, at one end thereof, with the common ink chamber 99*e*; and is communicated with, at the other end thereof, with one of the pressure chambers 10 via one of through holes 51 (described below). The apertures 52 are extended along the short direction of the channel unit 27. The cross-sectional area of each of the apertures 52 (a cross-sectional area in a direction orthogonal to a direction in which the aperture extends) is set to a predetermined dimension. In other words, the cross-sectional shape, cross-sectional area and length of the aperture 52 are determined so that the ink flows in the aperture 52 in a specific (predetermined) channel resistance. This limits the flow of ink which is about to flow back to a side of the common ink chamber 99*e* from one of the pressure chambers 10 when ink is jetted. Further, through holes 51 are formed in the supply plate 107. Each of the through holes 51 communicates, at one end thereof, with one of the pressure chambers 10 and communicates, at the other end thereof, with the other end of one of the apertures 52.

Furthermore, through holes 29 are formed in each of the plates 102 to 107. The through holes 29 formed in these plates 102 to 107 are mutually communicated, and the through holes 29, formed in the plates 102 and 107, communicates with one of the pressure chambers 10 and one of the nozzles 28, respectively. This forms a linear ink channel extending along a direction in which the plates are stacked (stacking direction) from one of the pressure chambers 10 and reaching the one of the nozzles 28.

The ink is jetted as described below, through the ink channels formed by mutually communicating the channel holes which are formed in the plates in such a manner. First, the ink which flowed from the common ink chamber 99*e* flows, via one of the apertures 52 and one of the through holes 51, toward the one end of the pressure chamber 10 disposed above the common ink chamber 99*e*. Then, the ink flows in the pressure chamber 10 and toward the other end of the pressure chamber 10, from where the ink flows downwardly through the through hole 29, to be jetted from the nozzle 28.

A damper groove 103*e* is formed in the damper plate 103 in a surface thereof facing the spacer plate 102, at a position corresponding to the common ink chamber 99*e*. The damper groove 103 is a groove formed such that a vertical cross section of the damper groove 103 along the short direction of the channel unit 27 is a recess-shaped groove; and that the damper groove 103 has same shape and size in plan view with those of the common ink chamber 99*e*. In addition to the damper groove 99*e*, damper grooves 103*a* to 103*d* are formed in the damper plate 103 at positions corresponding to the common ink chambers 99*a* to 99*d* (damper grooves 103*a* to 103*d* are not shown in the drawing). The damper grooves 103*a* to 103*d* have sizes and shapes in plan view as those of the common ink chambers 99*a* to 99*d*, respectively.

Figure 7:
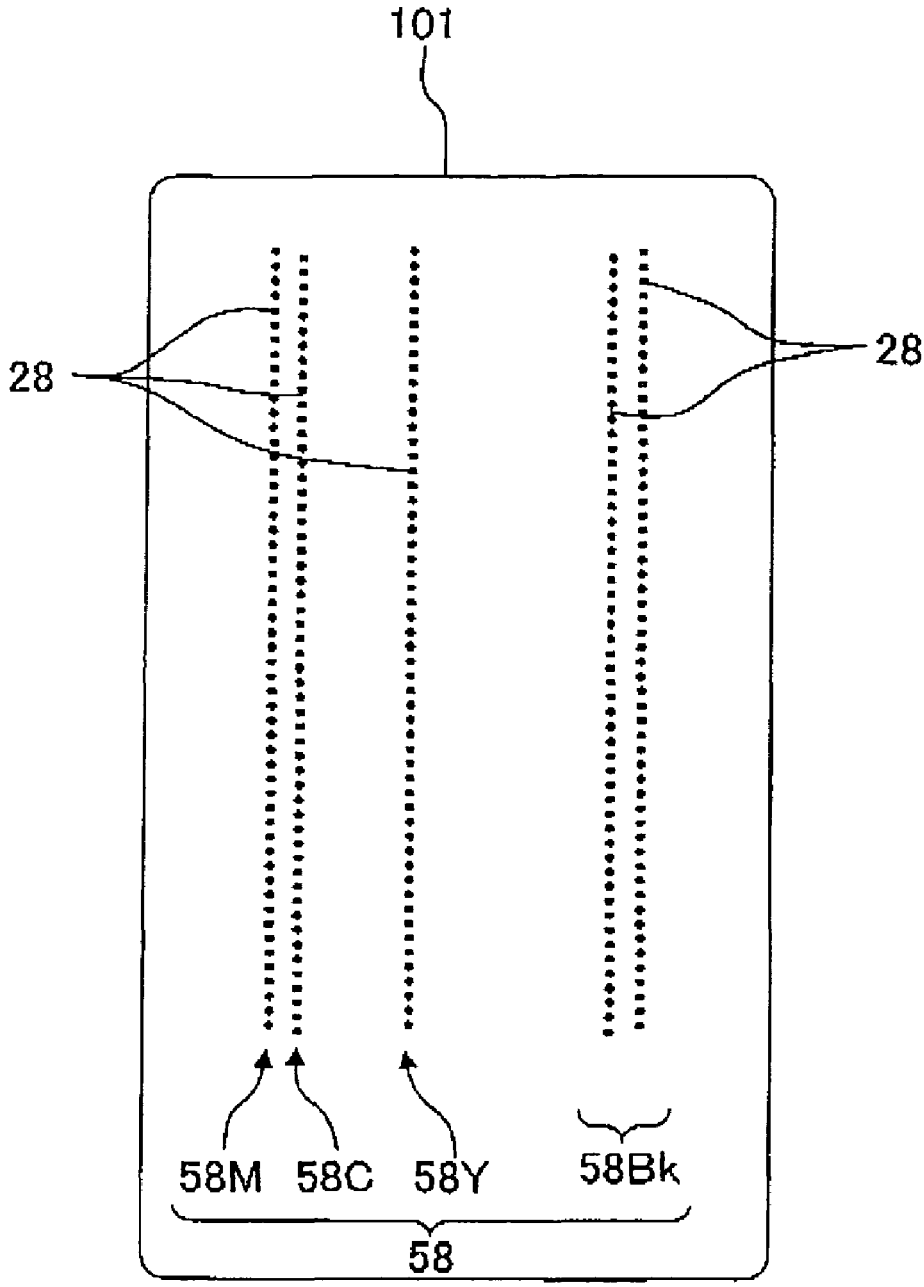
FIG. 7 is a bottom view of a nozzle plate shown in FIG. 6.

The ink-jet head 30 of the present invention jets a plurality of color inks. FIG. 7 shows a relationship between the nozzle rows 58 formed in the nozzle plate 101 and the colors of the inks jetted from the nozzle rows 58, respectively. As described above, five nozzle rows 58 are formed in the nozzle plate 101. An ink of one (same) color, among the color inks, is jetted from nozzles 28 belonging to a same nozzle row 58 among the nozzle rows 58. For example, a magenta ink is jetted from a nozzle row 58M aligned at one end in the short direction of the nozzle plate 101. Further, a cyan ink, a yellow ink and a black ink are jetted from nozzle rows 58C, 58Y and 58Bk, respectively.

Figure 8:
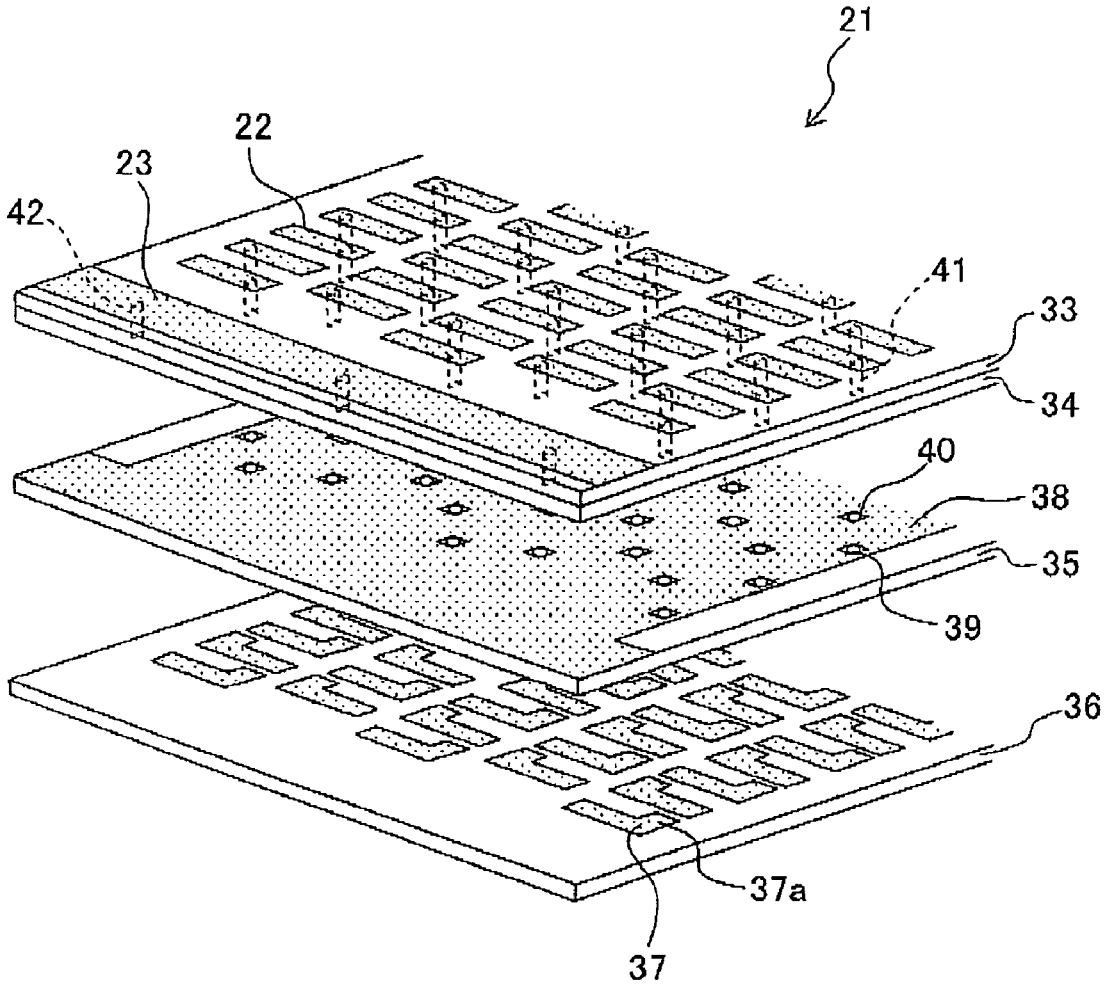
FIG. 8 is an exploded perspective view of a piezoelectric actuator shown in FIG. 3.

Next, the piezoelectric actuator 21 will be explained. FIG. 8 is an exploded perspective view of the piezoelectric actuator 21.

The piezoelectric actuator 21 is formed by stacking two insulating sheets 33, 34 and two piezoelectric sheets 35, 36. A plurality of individual electrodes 37 are formed, on the upper surface of the piezoelectric sheet 36, at positions facing the pressure chambers 10, respectively. These individual electrodes 37 are arranged in five rows, along the longitudinal direction of the piezoelectric sheet 36, in a staggered manner corresponding to the rows of the pressure chambers 10. Each of the individual electrodes 37 has a rectangular portion which is long in a plan view in the short direction of the piezoelectric sheet 36. Further, each of the individual electrodes 37 has an extended portion 37*a* drawn from one end, in the longitudinal direction of the individual electrode 37, and extended in the longitudinal direction of the piezoelectric sheet 36. The extended portion 37*a* is extended in the piezoelectric sheet 36 up to an area at which the extended portion 37*a* faces none of the pressure chambers 10.

A common electrode 38 is formed on the upper surface of the piezoelectric sheet 36 to cover the pressure chambers 10. On the upper surface of the piezoelectric sheet 35, a plurality of non-electrode areas 39 is formed in which the common electrode 38 is not formed (in which the common electrode 38 is partially absent). Through holes 40, which penetrate through the piezoelectric sheet 35 in the thickness direction thereof, are formed in the non-electrodes areas 39, respectively. In each of the through holes 40, an electrically conductive member is filled. The conductive member is electrically insulated from the common electrode 38. The non-electrode areas 39 are arranged at positions each facing the extended portion 37*a* of one of the individual electrodes 37.

On the upper surface of the insulating sheet 33 which is the uppermost layer of the stacked insulating sheets (namely, on the upper surface of the piezoelectric actuator 21), surface electrodes 22 which correspond to the individual electrodes 37 respectively and a surface electrode 23 are arranged. Each of the surface electrodes 22 is formed in the insulating sheet 33 at an area in which the surface electrode 22 does not face none of the pressure chambers 10, but faces one of the through holes 40 (or faces the extended portion 37*a* of one of the individual electrodes 37). Further, the surface electrodes 22 are arranged in five rows, along the longitudinal direction of the piezoelectric actuator 21, in a staggered manner corresponding to the individual electrodes 37, respectively. The surface electrode 23 is arranged in the insulating sheet 33 at a portion in the vicinity of one end, in the longitudinal direction, of the insulating sheet 33 and is extended in the short direction of the piezoelectric actuator 21.

A plurality of continuous holes 41 is formed in the insulating sheets 33, 34 penetrating through the thickness direction of the insulating sheets 33, 34. The continuous holes 41 are formed at an area facing the surface electrodes 22 and the extended portions 37*a*, so that the continuous holes 41 are positioned to face the through holes 40, respectively. Further, three continuous holes 42 are formed in the insulating sheets 33, 34 at an area facing the surface electrode 23 and the common electrode 38, such that the continuous holes 42 are arranged along the short direction of the insulating sheets 33, 34 and are isolated and away from one another. An electrically conductive member is filled in each of the continuous holes 41 and 42.

The piezoelectric actuator 21 has a stacked structure in which the insulating sheets 33, 34 and the piezoelectric sheets 35, 36, with the construction as described above, are stacked from above in this order. In such a stacked structure, the sheet-shaped members are stacked while the through holes 40 and the continuous holes 41 are positioned to face one another, thereby communicating the through holes 40 and the continuous holes 41 respectively so as to form a plurality of through holes penetrating the insulating sheets 33, 34 and piezoelectric sheet 35. Since the conductive member is filled in each of the through holes as described above, the surface electrodes 22 and the individual electrodes 37 are electrically connected, respectively. In addition, since the conductive material is also filled in the continuous holes 42 formed in the insulating sheets 33, 34 as described above, the surface electrode 23 and the common electrode 38 are electrically connected.

With such a construction, the respective individual electrodes 37 of the piezoelectric actuator 21 are connected, via the surface electrodes 22, to unillustrated individual wirings in the FPC 70. Further, the common electrode 38 is connected, via the surface electrode 23, to an unillustrated common wiring of the FPC 70. Furthermore, the individual wirings are connected to the driver IC 80.

On the other hand, the drive IC 80 converts a print signal, serially transmitted from the unillustrated control section of the printer 1, to a parallel signal which is corresponded to each of the individual electrodes 37 of the piezoelectric actuator 21. Further, the driver IC 80 generates, based on the print signal, a drive signal having a predetermined voltage pulse and outputs or transmits the generated drive signal to each of the individual wirings connected to one of the individual electrodes 37. The common wiring is always kept at ground electric potential.

With this configuration, the drive voltage (drive signal) from the driver IC 80 is selectively applied between any individual electrode 37 and the common electrode 38. When a predetermined voltage is applied between a certain individual electrode 37 and the common electrode 38, a distortion (deformation) in the stacking direction is generated in the piezoelectric sheets at an active portion thereof which is sandwiched by the certain individual electrode 37 and the common electrode 38. Then, the distortion generated in the active portion applies a pressure to the ink in a pressure chamber, corresponding to the certain individual electrode 37, thereby jetting the ink from a nozzle 28 corresponding to the pressure chamber 10.

Figure 9A:
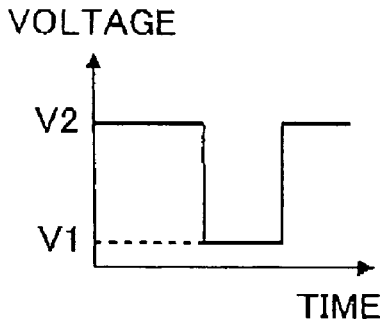
FIGS. 9A to 9D are views each showing jetting voltage pulse rows supplied (fed) to the piezoelectric actuator shown in FIG. 3.

FIGS. 9A to 9D each shows a jetting voltage pulse applied between the individual and common electrodes 37, 38 in the piezoelectric actuator 21 at the time of ink jetting. FIG. 9A shows a waveform of a most basic jetting voltage pulse upon jetting the ink by using the piezoelectric actuator 21 in a so-called pulling ejection manner. By applying this jetting voltage pulse, the ink is jetted from the nozzle 28 as described below.

As shown in FIG. 9A, the value of a voltage between the individual electrode 37 and the common electrode 38 is maintained, for example, V2 (V2 >0) before the ink is jetted. Accordingly, the piezoelectric actuator 21 is deformed at a portion thereof, which corresponds to a certain individual electrode 37 to which the voltage is applied, so as to project toward a pressure chamber 10 corresponding to the certain individual electrode 37. When the voltage pulse shown in FIG. 9A is applied, then the value of the voltage between the individual electrode 37 and the common electrode 38 changes once to V1 which is smaller than V2. At this time, the portion of the piezoelectric actuator 21 projected toward the pressure chamber 10 is deformed so as to withdraw or draw back in a direction from the inside to the outside of the pressure chamber 10. This increases the volume of the pressure chamber 10 quickly, thereby generating a negative pressure wave in the pressure chamber 10.

The negative pressure wave thus generated is propagated in a direction toward the outside of the pressure chamber 10. Then, the pressure wave is reflected, for example, in the aperture 52, and returned to the pressure chamber 10 as a positive pressure wave. On the other hand, as shown in FIG. 9A, the voltage between the individual electrode 37 and the common electrode 38, which was once changed to V1, is returned to V2 again at a predetermined time interval (after a predetermined period of time is elapsed). At this time, the volume of the pressure chamber 10 is decreased quickly to be returned to the state before the ink jetting, thereby generating a positive pressure wave in the pressure chamber 10.

In this case, a duration of a period of time when the voltage between the individual electrode 37 and the common electrode 38 is V1 is adjusted to be a duration of a period of time from when the above-described negative pressure wave is generated and until the pressure wave is returned to the pressure chamber 10 as the positive pressure wave. Therefore, the positive pressure wave generated when the increased volume of the pressure chamber 10 is returned to the state before the ink jetting and the positive pressure wave reflected and returned to the pressure chamber 10 are overlapped with each other, and the overlapped positive pressure waves are propagated in a direction from the pressure chamber 10 toward the nozzle 28. Thus, the ink is jetted from the nozzle 28.

Figure 9B:
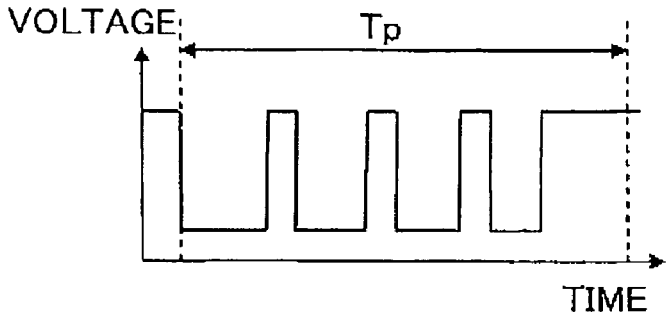

In actual ink jetting, the basic jetting pulse shown in FIG. 9A is emitted a plurality of times or emitted as a plurality of basic jetting pulses, as shown in FIG. 9B, and applied between the electrodes. Accordingly, an ink droplet is jetted from the nozzle 28 in an amount greater than in a case in which only one basic voltage pulse is applied. Note that the voltage pulse rows shown in FIGS. 9A to 9D respectively, are used upon jetting an ink droplet corresponding to one dot. Further, each of these voltage pulse rows has a time width of which length is within a time Tp during which the printing paper P is moved by a distance corresponding to one dot when the printing paper P is transferred (see FIG. 1). Each of the jetting voltage pulse rows is applied to the piezoelectric actuator 21 so as to synchronize with the length of time Tp during which the printing paper P is moved by one dot, namely synchronize with a printing cycle.

Figure 9C:
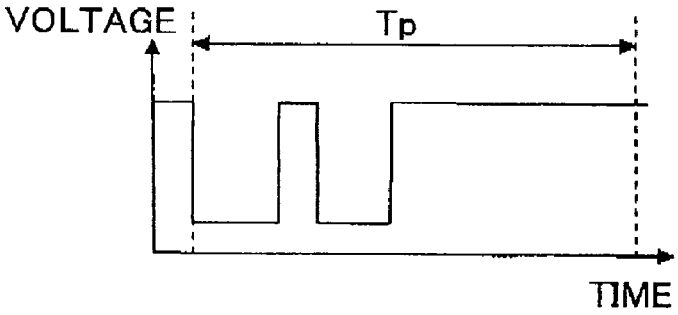
Figure 9D:
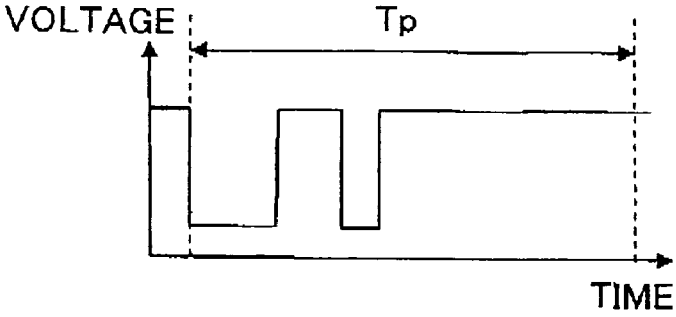

FIG. 9C shows an example of the jetting pulse for jetting an ink droplet having an ink amount smaller than that of the ink droplet jetted by the jetting pulse shown in FIG. 9B. The jetting pulse of FIG. 9C is formed of a pulse row in which the basic jetting pulse of FIG. 9A is emitted as two consecutive basic jetting pulses, and has a number of the jetting pulse is smaller than that in the jetting pulse of FIG. 9B. On the other hand, FIG. 9D shows an example of the jetting pulse for jetting an ink droplet having an ink amount smaller than that of the ink droplet jetted by the basic jetting pulse shown in FIG. 9C (consequently, further smaller than that of the ink droplet jetted by the basic jetting pulse shown in FIG. 9B). The jetting pulse of FIG. 90 is formed of a pulse row in which the basic jetting pulse of FIG. 9A is emitted as two consecutive basic jetting pulses, but a width of the one of the basic jetting pulses is smaller than a width of the other of the basic jetting pulses and an interval intervened in the two basic pulses are great.

As described above, sometimes a difference arises in the ink-jetting characteristics between a cases in which the ink is jetted concurrently from two nozzles 28 (multiple or concurrent jetting) and in a case in which the ink is jetted singly from each of the nozzles 28 (single jetting). In this specification, the phrase "the ink is jetted singly" means that the ink is jetted from a certain one nozzle 28 at a timing which is sufficiently apart or different from a timing at which the ink is jetted from another nozzle 28, to an extent that the ink-jetting from the certain nozzle 28 is not affected by the ink-jetting from the another nozzle 28; or that the ink is jetted from nozzles belonging to a certain nozzle row 58 at a timing which is sufficiently apart or different from a timing at which the ink is jetted from nozzles belonging to another nozzle row 58, to an extent that the ink-jetting from the nozzles belonging to the certain nozzle row 58 is not affected by the ink-jetting from the nozzles belonging to the another nozzle row 58.

When there is a difference or variation in the jetting characteristics between a case in which the ink is jetted from a single nozzle 28 and in a case the ink is jetted from two nozzles 28, there is a fear that an image formed by the ink-jetting is non-uniform in some cases. To solve this problem, the inventor confirmed that when the ink is jetted from two different nozzles in a same printing cycle, the ink-jetting characteristics are varied or become different depending on a delay time intervened in jetting timings for the two nozzles 28.

Figure 10A:
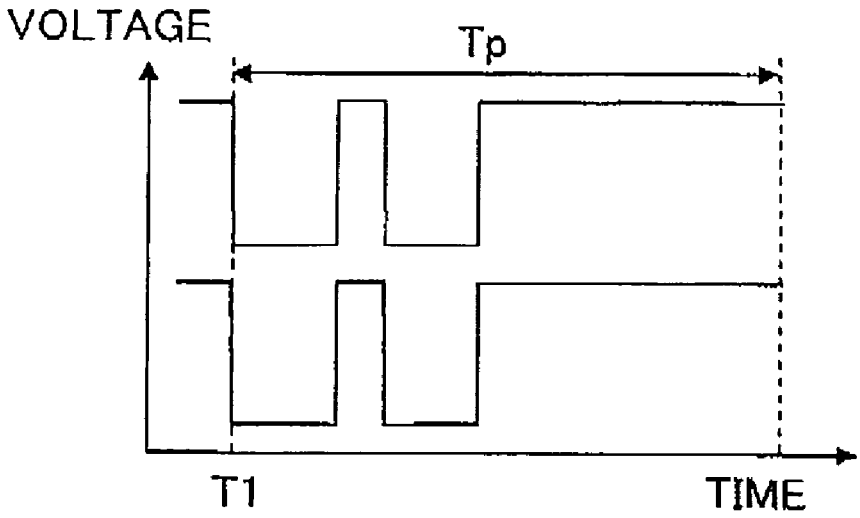
FIGS. 10A and 10B are views each showing a case in which the jetting voltage pulse rows, shown in FIG. 9C, is supplied twice in a same printing cycle (printing time)
Figure 10B:
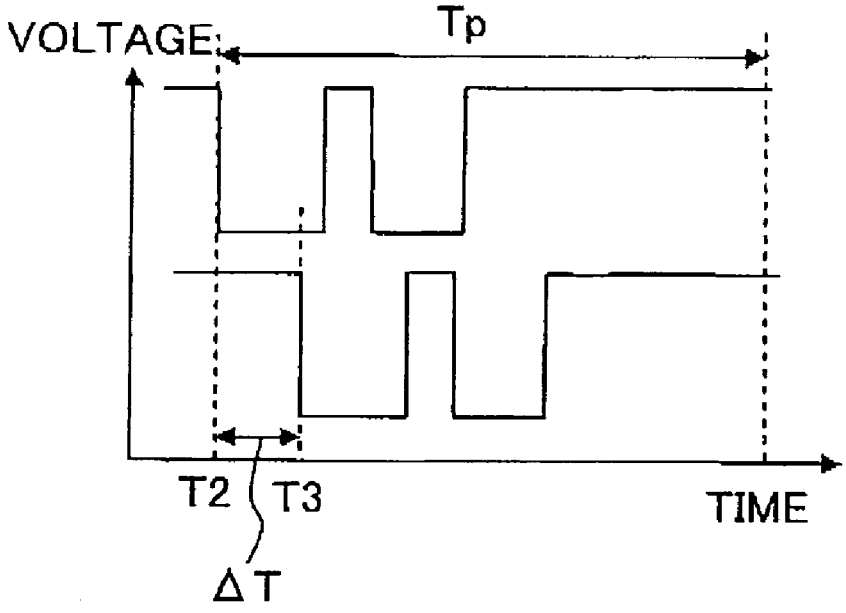

FIGS. 10A and 10B shows jetting pulses in cases in each of which two nozzles 28 jet the ink in a same printing cycle. FIG. 10A shows a case that a jetting pulse row is supplied at time T1 concurrently to portions of the piezoelectric actuator 21 corresponding to two nozzles 28. On the other hand, FIG. 10B shows a case that a jetting pulse row is supplied at a time T2 to one of the portions, of the piezoelectric actuator 21, corresponding to one of the two nozzles 28, and at a time T3 to the other of the portions, of the piezoelectric actuator 21, corresponding to the other of the two nozzles 28, with a delay time ΔT being intervened (between) the time T2 and the time T3. The inventor confirmed the fact that there is a difference in the ink-jetting characteristics between the cases shown in FIGS. 10A and 10B; and that in the case of FIG. 10B, the ink-jetting characteristics is varied or changed by changing the delay time ΔT.

Specifically, a measurement was performed as follows. Upon performing the measurement, the ink-jetting was performed for each of the nozzle rows, among the nozzle row 58C to the nozzle row 58H shown in FIG. 7, such that the ink was jetted concurrently from the each of the nozzle rows. In other words, the ink was jetted concurrently from the nozzles 28 belonging to each of the nozzle rows. Next, the ink jetting was performed for plurality of times while variously changing the delay time intervened in the jetting timings at each of which the ink was jetted from one of the nozzle rows. In each of the ink jettings, a jetting speed of the ink (ink jetting speed) jetted from each of the nozzle rows 58C to 58M was measured. A graph shown in FIG. 11 indicates the measurement results.

Figure 11:
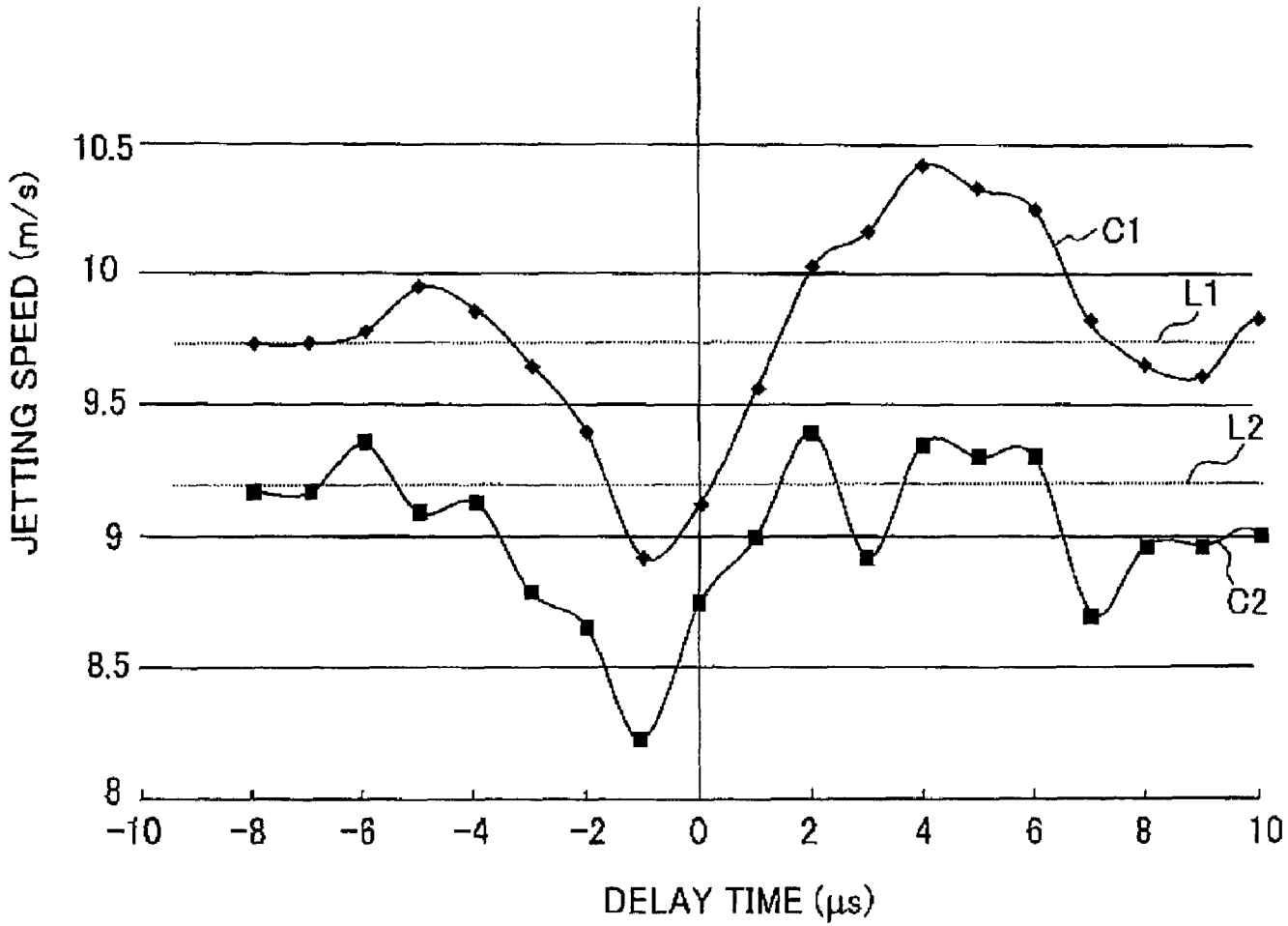
FIG. 11 is a graph showing jetting speeds at which the ink is jetted when the drive pulse signals, as shown in FIGS. 10A and 10B, are supplied to the piezoelectric actuator, respectively.

A horizontal axis in the graph in FIG. 11 indicates the delay time intervened in the jetting timings at which the ink was jetted from the nozzle rows 58C to 58M, respectively. Curves C1 and C2 each shows a jetting speed of the ink (ink-jetting speed) in which the ink was jetted, with delay times, from each of the nozzle rows 58C to 58M. Dotted lines L1 and L2 each shows an ink-jetting speed at which the ink was jetted independently or singly from each of the nozzle rows 58C and 58M. In this specification, the term "ink-jetting speed for each of the nozzle rows" is an average of all the ink-jetting speeds at which the ink was jetted from the nozzles 28 belonging to a certain nozzle row among the nozzle rows. Alternatively, the ink-jetting speed for each of the nozzle rows may also be an average of ink-jetting speeds in which the ink was jetted from some nozzles (a certain number of nozzles) 28 belonging to the certain nozzle row.

As shown in FIG. 11, when the delay time is zero, namely when the ink is jetted concurrently (simultaneously) from the two nozzle rows, the jetting speed of each of the nozzle rows is decreased (smaller) as compared to that in which the ink is jetted independently or singly from each of the nozzle rows. Further, the jetting speed when the delay time is zero and the jetting speed when the delay time is other than zero are different. In other words, when the ink is jetted by delaying or shifting the timings, it is appreciated that discharge characteristics obtained when the ink is jetted singly from each of the two nozzle rows are obtained are different from the discharge characteristics obtained when the ink is jetted concurrently from the two nozzle rows. Furthermore, it is appreciated that the jetting speed differs depending on the delay time.

Figure 12:
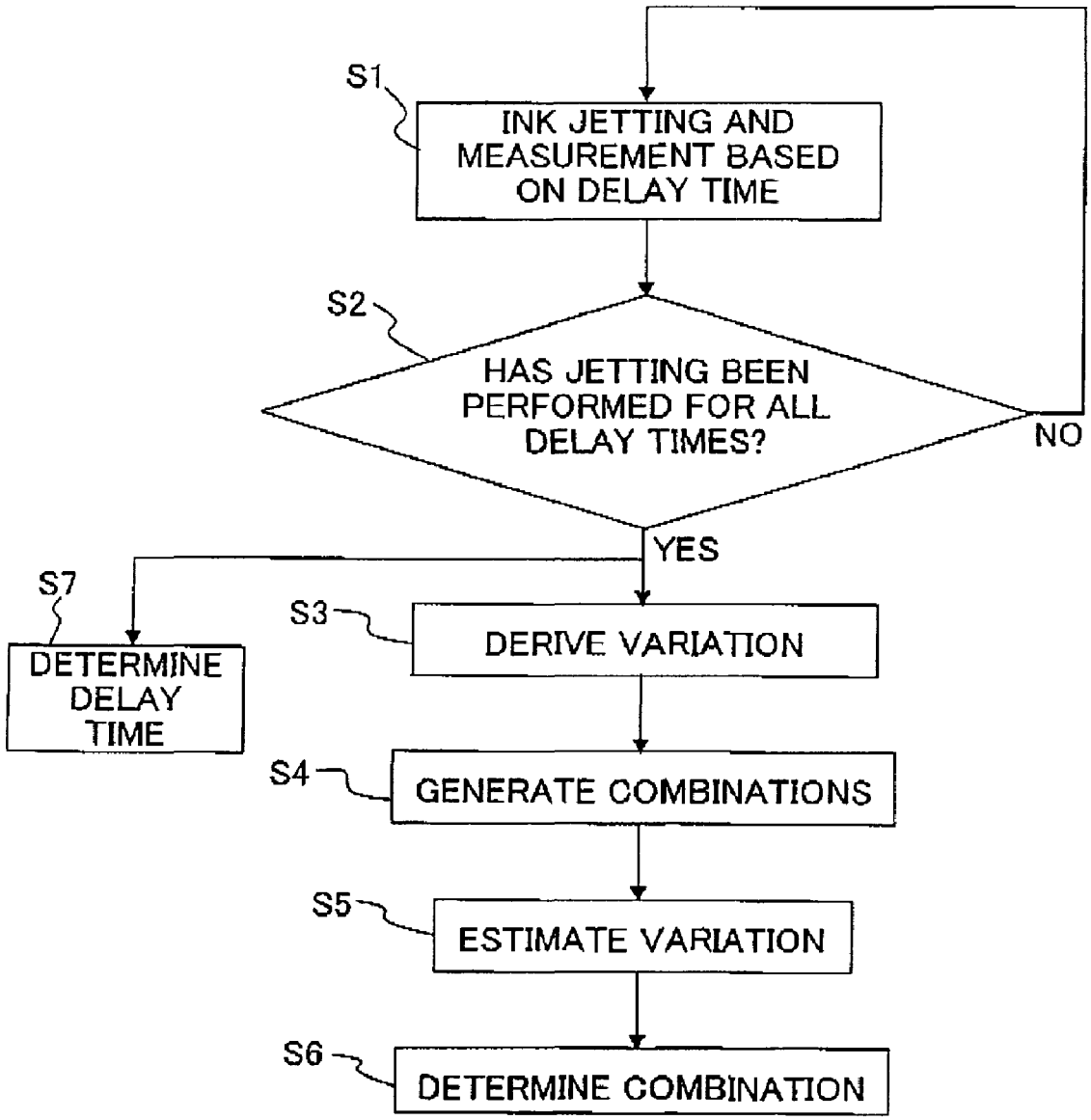
FIG. 12 shows a flow chart of a series of steps in the jetting-timing determining method as an embodiment of the present invention.

An explanation will be given about a method for determining optimum jetting timings, performed based on the above-described facts. FIG. 12 is a flowchart showing an overall flow of determination of the jetting timings.

Figure 13:
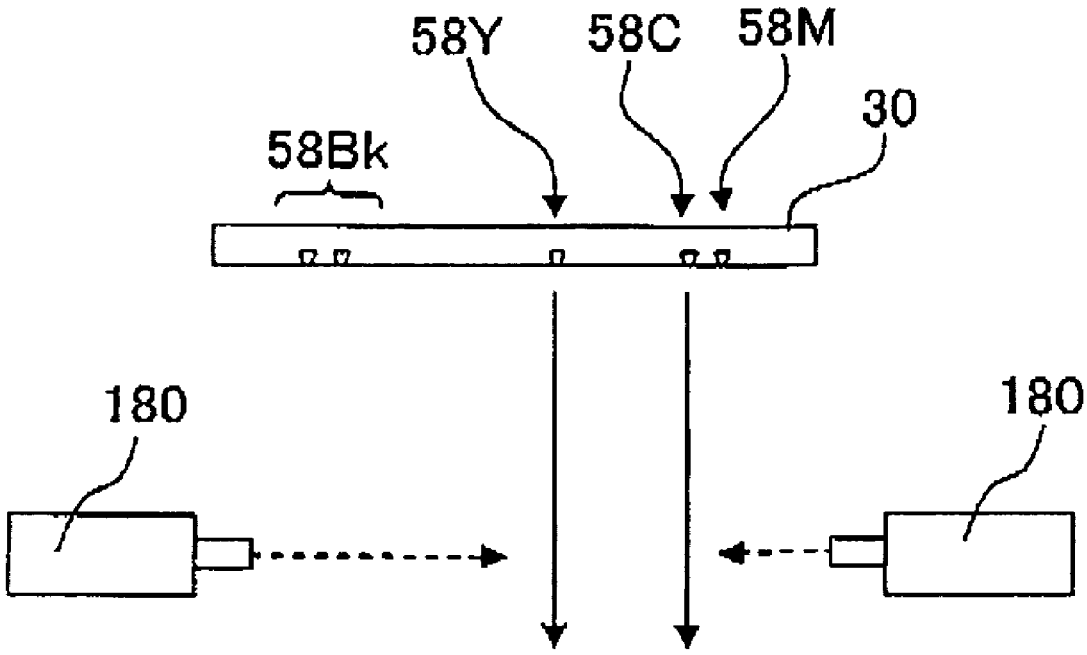
FIG. 13 is a schematic view explaining an ink-jetting step shown in FIG. 12.

Upon determining the jetting timings, firstly, as shown in FIG. 13, ink is jetted from a plurality of nozzle rows 58 based on combinations of the delay times intervened in the jetting timings set is advance (S1). In this embodiment, two nozzle rows (selected nozzle rows, selected nozzle groups) are selected among the nozzle rows 58Y, 58C, and 58M, and the ink is jetted concurrently from one of the nozzle rows and then concurrently from the other of the nozzle rows, with a predetermined delay time intervened in the respective jettings from the nozzle rows. In other words, although there is a delay time intervened in jetting timings for the nozzle rows respectively, the ink is jetted concurrently from the nozzles 28 belonging to each of the nozzle rows.

Further, in this embodiment, the ink is jetted only from nozzles which discharge a color ink. This is because, in an ink-jet head adopted for color printing, a quality of a color image is the most important factor. By jetting only the color ink(s), it is possible to determine the jetting timings by performing the ink jetting for a small number of times than in a case in which a black ink is also jetted. Furthermore, at the same time with the ink jetting, the ink-jetting speed is measured for each of the nozzle rows 58. The ink-jetting speed is measured, for example, by a method such as picture photography with a camera 180 or the like, as shown in FIG. 13 for example.

As shown in FIG. 9, when there is a plurality of jetting modes corresponding to jetting pulses for different amount of inks, it is preferable that the ink jetting in S1 is performed in a jetting mode with the least amount of the ink, among the jetting modes. In other words, it is preferable that the ink jetting is performed by using a jetting pulse in FIG. 9D. When the amount of ink is small, the influence of a cross-talk is likely to be more great than in a case in which the amount of ink is large. Consequently, by determining the optimum jetting timings based on the ink jetting performed in the jetting mode for which the amount of ink is small, it is possible to determine the jetting timings which are least likely to be affected by the cross-talk.

Alternatively, the ink jetting maybe performed for each of the jetting pulses shown in FIG. 9B to FIG. 9D, and the jetting timings maybe determined for each of the jetting pulses. Accordingly, it is possible to determine the optimum jetting timings corresponding to each of the plurality of modes in which the ink is jetted in different amounts respectively.

The measurement of jetting speed and the ink jetting (jetting step and measuring step) as described above are repeated for all of the delay times which are set in advance (S2: NO). When the ink jetting is completed for all the delay times, the next step is executed (S2: YES). Note in a case, for example, that an appropriate delay time is determined between two nozzle rows, it is also possible to determine, from the results in S1 and S2, a delay time in which the cross talk between the two nozzle rows is the least, among the delay times (S7, first determining step).

Table 1 and Table 2 in the following show an example of ink-jetting speeds measured as described above. In each of the ink jettings and of the measurements, the ink is jetted from two nozzle rows which are selected among the nozzle rows corresponding to the color inks as described above. For a combination of the two nozzle rows, there are three combinations of nozzle rows (three nozzle row combinations), namely a combination of (58C and 58M), a combination of (58M and 58Y), and a combination of (5BY and 58C). Table 1 and Table 2 shows, for each of the combinations of two nozzle rows (nozzle rows A and B), the jetting speeds for each of nozzle rows A and B for which the measurement was performed when the ink was jetted with various delay times each intervened in the ink-jettings from the nozzles A and B. Each of the delay times shown in Table 1 and Table 2 is a delay time of a jetting timing of nozzle row B with respect to a jetting timing of nozzle row A, and is in units of μs (microseconds). Further, a unit of the jetting speed is m/s (meters per second).

Next, a variation in the jetting speeds, measured for each of the nozzle rows 58 in S1, with respect to a predetermined ink-jetting speed, is derived (S4). Specifically, the variation is calculated by squaring a difference obtained by subtracting the reference value from each of the measured jetting speeds. In this embodiment, a value of 9.0 m/s is used as the reference value. Table 1 and Table 2 show, the combinations of the nozzle rows and the variation in each of the jetting speeds measured with the various delay times, respectively. For example, after the ink is jetted from the nozzle row 58C, when the ink is jetted from the nozzle row 58M with a delay time of 1 μs, the jetting speeds of the ink jetted from the nozzle row 58C and 58M are 9.0 m/s and 10.0 m/s, respectively. Consequently, the variations in the jetting speeds of the ink jetted from the nozzle row 58C and 58M are 0.0 and 1.0 respectively.

TABLE 1

| | A: C, B: M | | | A: M, B: Y Delay time | | | A: Y, B: C | | |
|---|---|---|---|---|---|---|---|---|---|
| | 0 | 1 | −1 | 0 | 1 | −1 | 0 | 1 | −1 |
| Jetting speed A | 9.6 | 9.0 | 9.8 | 10.1 | 10.0 | 10.3 | 8.8 | 8.2 | 9.0 |
| Jetting speed B | 9.6 | 10.0 | 9.3 | 9.5 | 9.7 | 9.3 | 9.1 | 9.6 | 8.9 |
| Variation A | 0.36 | 0.0 | 0.64 | 1.2 | 1.0 | 1.69 | 0.04 | 0.64 | 0.0 |
| Variation B | 0.36 | 1.0 | 0.09 | 0.25 | 0.49 | 0.09 | 0.01 | 0.36 | 0.01 |

TABLE 2

| | A: C, B: M | | A: M, B: Y Delay time | | A: Y, B: C | |
|---|---|---|---|---|---|---|
| | 2 | −2 | 2 | −2 | 2 | −2 |
| Jetting speed A | 9.4 | 9.9 | 9.5 | 10.3 | 8.7 | 9.4 |

TABLE 2-continued

| | A: C, B: M | | A: M, B: Y Delay time | | A: Y, B: C | |
|---|---|---|---|---|---|---|
| | 2 | −2 | 2 | −2 | 2 | −2 |
| Jetting speed B | 10.1 | 9.6 | 9.3 | 9.0 | 10.0 | 9.4 |
| Variation A | 0.16 | 0.81 | 0.25 | 1.7 | 0.09 | 0.16 |
| Variation B | 1.2 | 0.36 | 0.09 | 0.0 | 1.0 | 0.16 |

Next, combinations of delay times intervened in jetting timings when the ink is jetted from the three nozzle rows 58C, 58, and 58Y are generated by forming combinations of the delay times in the jetting timings when the ink is jetted from two nozzle rows shown in Table 1 and Table 2 (S4). Table 3 in the followings shows a part of combinations of the delay times which are possible by the combinations of the delay times shown in Table 1. Here, a combination (XYZ) represents or indicates a relative value (delay time) intervened in the timings at each of which the ink is jetted from one of the nozzle rows 58C, 58M, and 58Y successively or one after another.

For example, a combination (001) shows a case in which the ink is jetted from the nozzle row 58Y with a delay time of 1 μs after the ink is jetted concurrently from the nozzle rows 58C and 58M. Further, a combination (101) shows a case in which the ink is jetted from each of the nozzle rows 58M and 58Y with a delay time of only 1 μs from (after) a timing at which the ink is jetted from the nozzle row 58M. Furthermore, a combination (102) shows a case in which, after the ink is jetted from the nozzle row 58M, the ink is jetted from the nozzle rows 58C and 58Y with a delay time of 1 μs and a delay time of 2 μs, respectively.

Next, variations in the ink-jetting speeds when the ink is jetted from the three nozzle rows 58C, 58M, and 58Y are estimated, based on the generated combinations of the delay times (S6). Specific process of estimation is as follows. Firstly, the variations in the jetting speeds in Table 1 and Table 2 corresponding to the delay times generated in S4 are extracted, respectively. For example, as a variation in the jetting speeds corresponding to the combination (011) generated in S4, the variation in the jetting speeds in each of the cases when the delay time intervened in the nozzle rows 58C and 58M is 1 μs, the delay time intervened in the nozzle rows 58M and 58Y is 0 μs, and the delay time intervened in the nozzle rows 58C and 58Y is 1 μs are extracted from Table 1 and Table 2. Table 4 shows the extraction results. Table 4 shows that "delay intervened in (C and M)=0", "delay intervened in (M and Y)=1", and "delay intervened in (C and Y)=1" mean that the delay time is 0 μs intervened in the nozzle rows 58C and 58M, the delay time is 1 is intervened in the nozzle rows 58M and 58Y, and the delay time is 1 μs intervened in the nozzle rows 58C and 58Y, respectively. Further, in a column under "variation in C", "variation in M", and "variation in Y", the variations in the jetting speeds of the ink jetted from the nozzle rows 58C, 58M, and 58Y are shown for each of the delay times.

Based on the variations extracted in such a manner, the variations in the jetting speeds of ink when the ink is jetted from the three nozzle rows 58C, 58M, and 58Y are estimated. In this embodiment, as an index showing the variation objectively, an estimated S/N ratio which is calculated by the following numerical expression is used. In the last column at the bottom-left in Table 3, the estimated S/N ratio calculated in this manner is shown for each of the combinations of the delay times.

$$\text{(estimated S/N ratio)} = -10 \log_{10} [\text{(sum of variations extracted)}]$$

Since a logarithm of x is a simple increase in x, as the sum of the extracted variations is greater, the estimated S/N ratio is smaller. Consequently, according to the numerical expression described above, a case in which the estimated S/N ratio is great is equivalent to a case in which the variation in the jetting speeds is small.

TABLE 3

| | | | | | | |
|---|---|---|---|---|---|---|
| Combination | (000) | | | | | |
| Estimated S/N ratio | 4.6 | | | | | |
| Combination | (001) | (010) | (100) | (011) | (101) | (110) |
| Estimated S/N ratio | 4.7 | 3.6 | 3.0 | 4.2 | 4.3 | 2.7 |
| Combination | (012) | (021) | (102) | (120) | (201) | (210) |
| Estimated S/N ratio | 3.7 | 3.0 | 7.4 | 2.5 | 2.5 | 2.2 |

TABLE 4

| Delay intervened in (C and M) = 0 | | Delay intervened in (M and Y) = 1 | | Delay intervened in (C and Y) = 1 | |
|---|---|---|---|---|---|
| Variation in C | Variation in M | Variation in M | Variation in Y | Variation in C | Variation in Y |
| 0.36 | 0.36 | 1.0 | 0.49 | 0.010 | 0.0 |

The ink jetting performed in S1 includes a case, as shown in Table 1, in which the delay time between the two nozzle rows is zero, namely, a case in which the ink is jetted concurrently from all the nozzles 28 belonging to the two nozzle rows. Further, as shown in Table 3, an estimated S/N ratio when the ink is jetted concurrently from all the nozzles 28 belonging to the three nozzle rows is calculated from the variations in jetting speeds estimated when the ink was jetted concurrently from all the nozzles 28 belonging to the two such nozzle rows.

Next, a combination of the delay times is determined based on the estimated S/N ratios showed in Table 3 (S6). Specifically, among the estimated S/N ratios shown in Table 3, a combination of delay times is determined in which an estimated S/N ratio is higher than an estimated S/N ratio when the ink is jetted concurrently from all the nozzles 28 belonging to three nozzle rows. Combination (000) is equivalent to a case in which the ink is jetted concurrently from all the nozzles 28 belonging to the three nozzle rows, and in this case the estimated S/N ratio from Table 3 is "4.6". Further, cases having an estimated S/N ratio higher than the estimated S/N ratio of 4.6 are combination (001) and combination (102). Consequently, the delay times corresponding to the combination (001) and the combination (102), respectively, are determined to be the delay times intervened in jetting timings at each of which the ink is jetted from one of the three nozzle rows.

The combination of the delay times intervened in the jetting timings which is determined as described above shows the following effect when used in the ink-jet head. In other words, in a case of jetting the ink in a same printing cycle from the three nozzle rows formed in the ink-jet head, the ink is jetted at jetting timings based on the combination of the delay times having a higher estimated SIN ratio, as compared to the case in which the ink is jetted concurrently from the three nozzle rows. Consequently, as compared to the case in which the ink is jetted concurrently from the three nozzles, the variation in the jetting speeds is small, and an image formed by the ink jetting is uniform.

Further, since the combination of the delay times for the three nozzle rows is determined from the delay times for the two nozzle rows, the measurement of the jetting speed and the ink jetting are performed in a number of times smaller than in a case in which the ink jetting is performed for the combinations of various delay times in the three nozzle rows.

Further, the ink is jetted for all the combinations when two nozzle rows are extracted from the three nozzle rows. Consequently, the number of samples of the jetting speeds which are measured by the ink jetting is performed more times than in a case in which the ink jetting is performed only for a part of all the combinations. Accordingly, variations when the ink is jetted from the three nozzle rows is estimated even more assuredly.

When a nozzle row corresponding to the black ink, such as the nozzle row 58Bk, is formed in the ink-jet head, the jetting timing is determined as described below. Namely, a jetting timing, at which the ink is jetted from the nozzle row 58Bk corresponding to the black ink, is determined to be before or after (non-concurrent with) the jetting timings at each of which the ink is jetted from one of the three nozzle rows corresponding to the color inks respectively. For example, when the jetting timings of the three nozzle rows corresponding to the nozzle rows of color ink are determined at timings such that the ink is jetted in an order of "nozzle row 58C→(delay time of 1 μs)→nozzle row 58M→(delay time 1 μs)→nozzle row 58Y", the jetting timings including the nozzle row 58Bk are determined such as "nozzle row 58Bk→(delay time of 1 μs)→nozzle row 58C→(delay time of 1 μs)→nozzle row 58M→(delay time of 1 μs)→nozzle row 58Y". Alternatively, the jetting timings are determined such as "nozzle row 58C→(delay time of 1 μs)→nozzle row 58M→(delay time of 1 μs)→nozzle row 58Y→( (delay time of 1 μs)→nozzle row 58Bk. Here, the symbol "→" means "subsequently". By determining the timings in such manner, the ink jettings from the nozzle rows 58C to 58Y for color inks, for which the jetting timings are adjusted such that the variation in the jetting speeds is small, is hardly affected by the ink jetting from the nozzle row 58Bk.

Modified Embodiment

The preferred embodiment of the present invention has been explained above. However, the present invention is not limited to the embodiment described above, and can be changed in various ways within the range defined in the claims.

For example, the embodiment described above adopts, as a method for determining the combination of the delay times, a method in which an estimated S/N ratio in a case in which the ink is jetted concurrently from all the nozzle rows 28 belonging to the three nozzle rows, is made to be a reference. However, the combination of the delay times may be determined with a value other than the reference, as a threshold value of the estimated S/N ratio. For example, a relationship between the estimated S/N ratio and a quality of image formed actually may be confirmed by an experiment, and a minimum estimated S/N ratio for obtaining an image of a desired quality may be determined, and a value of the determined S/N ratio may be made to be the threshold value.

Further, in the embodiment described above, a combination of the delay times between the jetting timings for the three nozzle rows is determined by discharging the ink from the two nozzle rows with respect to a various delay times. Consequently, since one delay time is intervened in the two jetting timings in the two nozzle rows, the ink jetting is performed for plurality of times by changing one delay time.

However, for example, upon determining a combination of delay times among jetting timings in the five nozzle rows, the combination of the delay times may also be determined by discharging the ink from the three nozzle rows. In this case, since two delay times are intervened in the three jetting timings in the three nozzle rows, the ink jetting is performed for plurality of times by changing two delay times. Accordingly, the ink is jetted in various combinations of the two delay times. For example, certain ink jetting is performed at jetting timings of: "an ink jetting from a first nozzle row →(delay time of 1 μs)→an ink jetting from a second nozzle row→(delay time of 2 μs)→an ink jetting from a third nozzle row", and further another ink jetting is performed at jetting timings of: "an ink jetting from a fourth nozzle row→(delay time of 0 μs)→an ink jetting from the first nozzle row→(delay time of 1 μs)→an ink jetting from a fifth nozzle row". Further, the jetting speed for each of the nozzle rows is measured.

Next, combinations of four delay times when the ink is jetted from the five nozzle rows are generated from the combination of two such delay times. In the example described above, the delay times correspond to the combinations of jetting timings of (0, 1, 3, -,- ) and of (0, -, -, 0, 1). Here, "(a, b, c, d, e)" indicates relative values of the jetting timings in the nozzle rows from the first nozzle row to the fifth nozzle row. By these two combinations, a combination of the jetting timings of (0, 1, 3, 0, 1) is generated. Further, from among combinations generated in such manner, a combination in which the variation in the jetting speeds is less than a predetermined threshold value is determined.

Further, it is not necessarily indispensable that the ink is jetted from a same number of nozzle rows every time. For example, for a certain ink jetting, the ink may be jetted from two nozzle rows, and for another ink jetting, the ink may be jetted from three nozzle rows.

Furthermore, in the embodiment described above, the ink jetting is performed for all the combinations when two nozzle rows are extracted from the three nozzle rows. However, the ink jetting may be performed only for a part of the combinations for the two nozzle rows.

In the embodiment described above, the jetting timing for all the nozzle rows is determined without performing the ink jetting from the nozzle row 58Bk corresponding to the black ink, However, the jetting timing may be determined with performing the ink jetting from the nozzle row 58Bk also.

Further, in the embodiment described above, the ink-jet head is assumed to be an ink-jet head having a plurality of nozzle rows which are formed in the ink-jet head and each of which is constructed of a plurality of nozzles. However, the present invention may also be applied to an ink-jet head having one nozzle row. In this case, a jetting timing is determined for each of the nozzles. In other words, delay times intervened in jetting timings are set for the nozzles respectively; the ink jetting is performed in accordance with the delay times; and an optimum combination of the delay times is determined. Alternatively, delay times may be determined for jetting timings at each of which the ink is jetted from one of nozzle groups each of which is formed of three nozzles included in one nozzle row.

In the embodiment, it is assumed to determine the jetting timing for each of the nozzle rows. It is allowable, however, to determine jetting timings for nozzle groups respectively, the nozzle groups being different from the nozzle rows. For example, the jetting timings may be determined for nozzle groups, respectively, each of the nozzle groups being formed of a half of nozzles in one of the nozzle rows. Alternatively, the present application may be applied to an ink-jet head in which the nozzle rows are not formed. In this case, the jetting timings may be determined for the nozzles, respectively; or may be determined for nozzle groups respectively, each of the nozzle groups being formed of two nozzles. In each of the cases, the delay time for the jetting timings is treated corresponding to each of the nozzle groups considered as a unit.

In the embodiment as described above, an appropriate timing is determined based on an ink-jetting performed in a jetting mode in which the amount of the ink jetted from the nozzle is the least among the modes. It is possible, however, to determine jetting timings also for other modes different from this mode with the least ink-jetting amount, and to adopt jetting timings according to each of the other modes. For example, in a case which requires jetting small ink droplets for printing an image such as a photograph at a high resolution, it is allowable to perform waveform control corresponding to jetting timings in which the cross talk is suppressed or not substantial when small droplets are jetted. On the other hand, in another case which requires jetting large ink droplets for printing an area of a solid color, it is allowable to perform waveform control corresponding to jetting timings in which the cross talk is suppressed or not substantial when large droplets are jetted. Alternatively, it is possible to determine optimum jetting timings, also for a case in which large ink droplets and small ink droplets are jetted substantially concurrently, in a similar method or technique as described in the embodiment. In such a manner, it is allowable to perform waveform control of the signal to be applied to a piezoelectric actuator at jetting timings suitable for various jetting modes, respectively, depending on ink droplet-amounts.

In the ink-jet head of the embodiment as described above, when printing is performed in a high-definition mode (high-image quality mode), only three inks of yellow, cyan and magenta colors are used; and when printing is performed in a high-speed mode, the black ink is used in addition to the three color inks. In such a case, the jetting timings may be determined with the above-described method for each of the high-definition mode using only the three color inks and the high-speed mode using the four color inks including the black ink. Alternatively, for example, it is allowable to determine jetting timings by focusing on a predetermined combination of colors, such as yellow and black inks, such that the cross talk is particularly suppressed for the combination of such colors. In the embodiment, the variation in jetting speeds of the ink droplets is derived upon determining the jetting timings. It is also possible, however, to determine jetting timings such that the cross talk is particularly suppressed for the predetermined combination of color inks, by weighing values of variations derived.

Figure 14A:
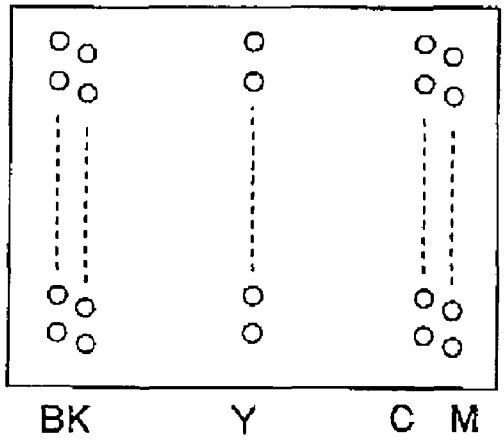
FIGS. 14A to 14D show examples of nozzle arrangement respectively.
Figure 14B:
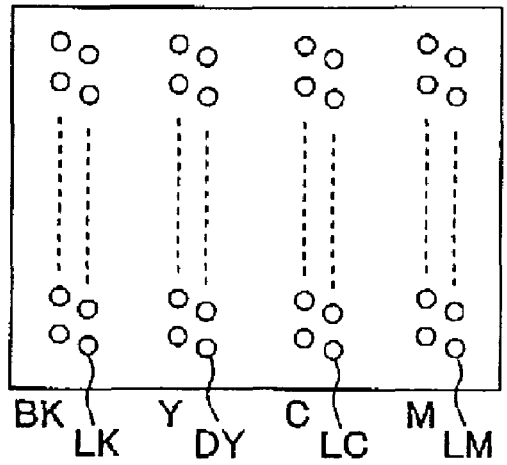
Figure 14C:
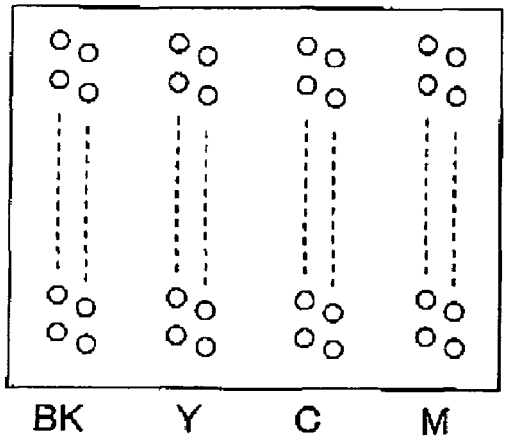
Figure 14D:
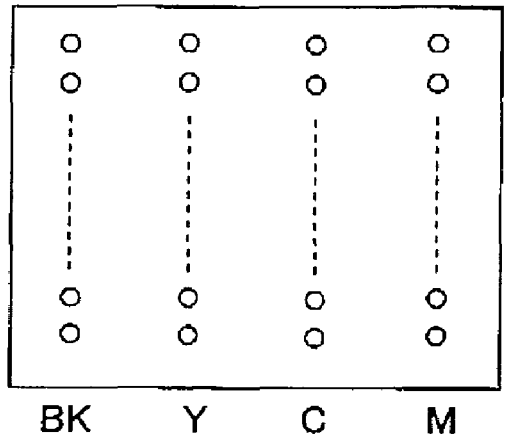

The liquid-droplet jetting head, to which the liquid-droplet jetting method or the jetting timing determining method of the present invention is applicable, is not limited to an ink-jet head in which the nozzles are arranged as described in the embodiment. The methods of the present invention can be applicable to various ink-jet heads (or liquid-droplet jetting heads) having various nozzle arrangements. FIGS. 14A to 14D show nozzle-arrangement examples 1 to 4. As shown in FIG. 14A, it is allowable to arrange the nozzles such that two nozzle rows jet a black ink (Bk); that three nozzle rows jet an yellow ink (Y), a cyan ink (C) and a magenta ink (M) respectively; and that the nozzle row jetting the Y ink is arranged away from the nozzles rows each jetting the ink other than the Y ink. Alternatively, as shown in FIG. 14B, it is allowable to form, in addition to the nozzle rows jetting the four color inks, nozzle rows jetting a light black ink (LK), a dark yellow ink (DY), a light cyan ink (LC) and a light magenta ink (LM), respectively. Still alternatively, as shown in FIG. 14C, it is allowable that each of the Bk, Y and M inks is jetted from two nozzle rows. Further alternatively, as shown in FIG. 14D, it is allowable that each of the inks is jetted from one of the nozzle rows. In any of these cases, the order of which the nozzle rows are arranged per the color of the inks and the number of nozzle row for each of the color inks maybe arbitrary. Further, the positional relationship among the nozzle rows in the row-arrangement direction may be arbitrary. For example, as shown in FIG. 14C, it is allowable that two nozzle rows which are mutually adjacent are shifted from each other; and as shown in FIG. 14D, it is allowable that the adjacent rows are aligned in the row-arrangement direction.

A liquid-droplet jetting head to which the liquid-droplet jetting method or the jetting timing determining method of the present invention is applicable is not limited to an ink-jet head which jets an ink, and may be a liquid-droplet jetting head which jets a liquid other than ink such as a reagent, a biomedical solution, a wiring material solution, an electronic material solution, a cooling medium (refrigerant), a liquid fuel, or the like.

What is claimed is:

1. A jetting timing determining method for determining jetting timings at which a liquid is jetted from a liquid droplet head having a plurality of nozzles including a first nozzle and a second nozzle which are to jet liquid droplets concurrently, the method comprising:

a jetting step for jetting a first liquid droplet from the first nozzle a plurality of times at a respective plurality of first timings, and jetting a corresponding second liquid droplet from the second nozzle a plurality of times at a respective plurality of second timings, each of the second timings being shifted from each of the corresponding first timings by a respective one of a plurality of predetermined periods of time;

a measuring step for measuring a plurality of first jetting speeds at which the first liquid droplets are jetted from the first nozzle and a plurality of second jetting speeds at which the second liquid droplets are jetted from the second nozzle in the jetting step; and a first determining step for determining a delay time between a third timing of a third liquid droplet being jetted from the first nozzle and a fourth timing of a fourth liquid droplet being ejected from the second nozzle, based on the measured plurality of first and second jetting speeds.

2. The jetting timing determining method according to claim 1;

wherein the liquid droplets are liquid droplets of an ink;

wherein the liquid droplet head is an ink-jet head;

wherein the nozzles form a plurality of nozzle groups each of which includes multiple nozzles;

wherein two of the nozzles groups are selected as a grouping of nozzle groups;

wherein the jetting step includes an ink-jetting step for jetting a plurality of first liquid droplets concurrently from the nozzles of one of the nozzle groups of the selected grouping a plurality of times at the respective plurality of first timings, and jetting a corresponding plurality of second liquid droplets from the nozzles of the other of the nozzle groups of the selected grouping a plurality of times at the respective plurality of second timings which are each shifted from each of the corresponding first timings by the respective one of the plurality of predetermined periods of time;

wherein in the measuring step, jetting speeds of the ink jetted from the selected nozzle groups, respectively, are measured for each of the selected nozzle groups; and wherein the first determining step includes:

a generating step for generating second delay-time combinations from first delay-time combinations, each of the first delay-time combinations being a combination of the delay times by each of which the jetting timing at which the ink is jetted from one of the nozzle groups of the selected grouping is shifted with respect to the predetermined periods of time, each of the second delay-time combinations being a combination of delay times by each of which a jetting timing at which the ink is jetted from one of the nozzle groups of the selected grouping is shifted with respect to the predetermined periods of time;

a first estimating step for estimating, with respect to each of the second delay-time combinations, a variation in jetting speeds at which the ink is concurrently jetted from nozzles included in each of the nozzle groups of the selected grouping, with respect to a predetermined ink-jetting speed, from a variation in the jetting speeds measured for each of the nozzle groups of the selected grouping in the measuring step; and a second determining step for determining a second delay-time combination, among the second delay-time combinations, in which the variation in the jetting speeds estimated in the first estimating step is smaller than a threshold value.

3. The jetting timing determining method according to claim 2;

wherein the ink-jetting step is performed a plurality of times by changing nozzle groups which belong to the selected grouping of nozzle groups so as to create multiple selected groupings of nozzle groups, each of the plurality of nozzle groups belonging to one of the selected groupings of nozzle groups.

4. The jetting timing determining method according to claim 3;

wherein the ink-jetting step is performed a plurality of times by changing nozzle groups which belong to the selected groupings of nozzle groups, so that the selected groupings of nozzle groups include all pairs of nozzle groups extracted from the plurality of nozzle groups.

5. The jetting timing determining method according to claim 2;

wherein the ink-jetting step is performed a plurality of times by changing nozzle groups which belong to the selected grouping of nozzle groups so as to create multiple selected groupings of nozzle groups while maintaining a number of the nozzle groups in each of the selected groupings to be less than a number of all the nozzle groups.

6. The jetting timing determining method according to claim 2;

wherein the ink-jetting step is performed a plurality of times by changing nozzle groups belonging to the selected grouping of nozzle groups so as to create multiple selected groupings of nozzle groups, without changing a number of the nozzle groups included in each of the selected groupings of nozzle groups.

7. The jetting timing determining method according to claim 2;

wherein the ink-jetting step includes a concurrent-jetting step for jetting the ink concurrently from all the nozzles which belong to the selected grouping of nozzle groups;

wherein the first estimating step includes a second estimating step for estimating, from the jetting speeds at which the ink is jetted in the concurrent-jetting step, a variation in jetting speeds at which the ink is to be jetted concurrently from all the nozzles belonging to the selected grouping of nozzle groups; and wherein in the second determining step, the second delay-time combination is determined, from the second delay-time combinations, in which the variation in the ink jetting speeds estimated in the first estimating step is less than the variation in the ink jetting speeds estimated in the second determining step.

8. The jetting timing determining method according to claim 2;

wherein the first estimating step includes:

a deriving step for deriving, for each of the nozzle groups of the selected grouping, variations in the ink jetting speeds, measured in the measuring step, with respect to the predetermined ink-jetting speed;

an extracting step for extracting, from the variations in the ink jetting speeds derived in the deriving step, a combination of variations in the ink jetting speeds which corresponds to the second delay-time combination; and a step for estimating a variation in the ink jetting speeds at which the ink is to be jetted from the nozzle groups of the selected grouping, based on the combination of the variations extracted in the extracting step.

9. The jetting timing determining method according to claim 2;

wherein the ink-jet head includes a nozzle surface having a plurality of nozzle rows formed and aligned in parallel in the nozzle surface;

wherein each of the nozzle rows includes nozzles among the plurality of nozzles; and wherein each of the plurality of nozzle groups is one of the plurality of nozzle rows respectively.

10. The jetting timing determining method according to claim 9;

wherein the ink includes a plurality of color inks including a black ink; and wherein, in the ink-jetting step, (1) nozzles which belong to one nozzle row of the selected rows jet one color ink, among the color inks, and (2) nozzles which belong to another nozzle row of the selected rows jet another color ink different from the one color ink.

11. The jetting timing determining method according to claim 9;

wherein the ink includes a plurality of color inks including a black ink;

wherein the ink-jetting step is performed such that a nozzle row, among the plurality of nozzle rows, which jets the black ink does not belong to the selected grouping of nozzle groups; and wherein the jetting timings at which the ink is jetted from the plurality of nozzles are determined such that a jetting timing of a nozzle row, among the nozzle rows, which jets the black ink, is non-concurrent with a jetting timing of another nozzle row, among the nozzle rows, which jets a color ink other than the black ink.

12. The jetting timing determining method according to claim 2;

wherein each of the nozzles belongs to one of the plurality of nozzle groups.

13. The jetting timing determining method according to claim 2;

wherein an ink-jetting performed by the ink-jet head includes a plurality of modes which are mutually different in an amount of the ink jetted from the nozzles; and wherein in the ink-jetting step, the ink is jetted from the nozzles in a mode in which the ink is jetted in a least amount among the modes.

14. The jetting timing determining method according to claim 2;

wherein an ink-jetting performed by the ink-jet head includes a plurality of modes which are mutually different in an amount of the ink jetted from the nozzles;

wherein the ink is jetted from the nozzles in each of the modes; and wherein in the second determining step, the second delay-time combination is determined in each of the modes.

15. The jetting timing determining method according to claim 9;

wherein the nozzle rows are formed as four nozzle rows in the ink-jet head.

16. A liquid-droplet jetting method for jetting liquid droplets from a liquid-droplet jetting head having a plurality of nozzles including a first nozzle and a second nozzle which are to jet the liquid droplets concurrently, the method comprising:

a jetting step for jetting a first liquid droplet from the first nozzle a plurality of times at a respective plurality of first timings, and for jetting a corresponding second liquid droplet from the second nozzle a plurality of times at a respective plurality of second timings, each of the second timings being shifted from each of the corresponding first timings by a respective one of a plurality of predetermined periods of time;

a measuring step for measuring a plurality of first jetting speeds at which the first liquid droplets are jetted from the first nozzle and a plurality of second jetting speeds at which the second liquid droplets are jetted from the second nozzle in the jetting step;

a first determining step for determining a delay time between a third timing of a third liquid droplet being jetted from the first nozzle and a fourth timing of a fourth liquid droplet being ejected from the second nozzle, based on the measured plurality of first and second jetting speeds; and a step for jetting the third liquid droplet from the first nozzle and the fourth liquid droplet from the second nozzle, by the delay time determined in the first determining step.

17. The liquid-droplet jetting method according to claim 16;

wherein the liquid droplets are liquid droplets of an ink;

wherein the nozzles form a plurality of nozzle groups each of which includes multiple nozzles;

wherein two of the nozzles groups are selected as a grouping of nozzle groups;

wherein the jetting step includes an ink-jetting step for jetting a plurality of first liquid droplets concurrently from the nozzles of one of the nozzle groups of the selected grouping a plurality of times at the respective plurality of first timings, and jetting a corresponding plurality of second liquid droplets from the nozzles of the other of the nozzle groups of the selected grouping a plurality of times at the respective plurality of second timings which are each shifted from each of the corresponding first timings by the respective one of the plurality of predetermined periods of time;

wherein in the measuring step, jetting speeds of the ink jetted from the selected nozzle groups, respectively in the ink-jetting step, are measured for each of the selected nozzle groups; and wherein the first determining step includes:

a generating step for generating second delay times from first delay-time combinations, each of the first delay-time combinations being a combination of the delay times by each of which the jetting timing at which the ink is jetted from one of the nozzle groups of the selected grouping is shifted with respect to the predetermined periods of time, each of the second delay-time combinations being a combination of delay times by each of which a jetting timing at which the ink is jetted from one of the nozzle groups of the selected grouping is shifted with respect to the predetermined periods of time;

a first estimating step for estimating, with respect to each of the second delay-time combinations, a variation in jetting speeds at which the ink is concurrently jetted from the nozzles included in each of the nozzle groups of the selected grouping, from a variation in the jetting speeds measured for each of the nozzle groups of the selected grouping in the measuring step; and a second determining step for determining a second delay-time combination, among the second delay-time combinations, in which the variation in the jetting speeds estimated in the first estimating step is smaller than a threshold value.

18. The liquid-droplet jetting method according to claim 17;

wherein the ink-jetting step includes a concurrent-jetting step for jetting the ink concurrently from all the nozzles which belong to the selected groupings of nozzle groups;

wherein the first estimating step includes a second estimating step for estimating, from the jetting speeds at which the ink is jetted in the concurrent-jetting step, a variation in jetting speeds at which the ink is to be jetted concurrently from all the nozzles belonging to the selected grouping of nozzle groups; and wherein in the second determining step, the second delay-time combination is determined, from the second delay-time combinations, in which the variation in the ink jetting speeds estimated in the first estimating step is less than the variation in the ink jetting speeds estimated in the second determining step.

19. The liquid-droplet jetting method according to claim 17;

wherein the first estimating step includes:

a deriving step for deriving, for each of the nozzle groups of the selected grouping, variations in the ink jetting speeds, measured in the measuring step, with respect to the predetermined ink-jetting speed;

an extracting step for extracting, from the variations in the ink jetting speeds derived in the deriving step, a combination of variations in the ink jetting speeds which corresponds to the second delay-time combination; and a step for estimating a variation in the ink jetting speeds at which the ink is to be jetted from the nozzle groups of the selected grouping, based on the combination of the variations extracted in the extracting step.

20. The liquid-droplet jetting method according to claim 17;

wherein the liquid-droplet jetting apparatus is an ink-jet head including a nozzle surface which has nozzle rows formed and aligned in parallel in the nozzle surface;

wherein each of the nozzle rows includes nozzles among the plurality of nozzles; and wherein each of the plurality of nozzle groups is one of the plurality of nozzle rows respectively.

21. The liquid-droplet jetting method according to claim 20;

wherein the ink includes a plurality of color inks including a black ink; and wherein in the ink-jetting step, (1) nozzels which belong to one nozzle row of the selected rows jet one color ink, among the color inks, and (2) nozzles which belong to another nozzle row of the selected rows jet another color ink different from the one color ink.

* * * * *